US012773725B2

(12) United States Patent
South

(10) Patent No.: US 12,773,725 B2
(45) Date of Patent: Oct. 27, 2026

(54) METHODS AND APPARATUS FOR FABRICATING AND RETROFITTING DOME SHAPED BUILDINGS USING COILED REBAR

(71) Applicant: Dome Technology, LLC, Idaho Falls, ID (US)

(72) Inventor: Jason P. South, Idaho Falls, ID (US)

(73) Assignee: Dome Technology, LLC, Idaho Falls, ID (US)

( * ) Notice: Subject to any disclaimer, the term of this patent is extended or adjusted under 35 U.S.C. 154(b) by 94 days.

(21) Appl. No.: 18/755,333

(22) Filed: Jun. 26, 2024

(65) Prior Publication Data

US 2024/0424543 A1 Dec. 26, 2024

Related U.S. Application Data

(60) Provisional application No. 63/510,210, filed on Jun. 26, 2023.

(51) Int. Cl.

| | |
|---|---|
| ***B21C 47/16*** | (2006.01) |
| ***E04B 1/16*** | (2006.01) |
| ***E04B 1/32*** | (2006.01) |
| ***E04G 21/12*** | (2006.01) |

(52) U.S. Cl.

CPC ..... *B21C 47/16* (2013.01); *E04B 1/169* (2013.01); *E04B 1/3211* (2013.01); *E04G 21/12* (2013.01)

(58) Field of Classification Search

CPC ..... B21C 47/16; E04G 21/12; E04G 11/04; B21D 3/02; B21D 11/12; B21F 1/02; E04B 1/166

See application file for complete search history.

(56) References Cited

U.S. PATENT DOCUMENTS

| | | | | |
|---|---|---|---|---|
| 2,223,418 A | | 12/1940 | Hewett | |
| 2,335,300 A | | 11/1943 | Neff | |
| 2,385,296 A | | 9/1945 | Moore | |
| 2,580,231 A | | 12/1951 | Lamm | |
| 2,820,990 A | | 1/1958 | Johnson | |
| 3,206,899 A | * | 9/1965 | Wright | B29D 25/00 D25/19 |
| 3,246,439 A | | 4/1966 | Foster, Jr. et al. | |

(Continued)

FOREIGN PATENT DOCUMENTS

| | | |
|---|---|---|
| JP | 4096202 B2 | 6/2008 |
| JP | 4660823 B2 | 3/2011 |

(Continued)

OTHER PUBLICATIONS

Freda Parker, *Crenosphere, A Dream Come True*, Roundup Journal of the Monolithic Dome Institute, Winter 2000, pp. 24-27.

(Continued)

*Primary Examiner* — Patrick J Maestri
(74) *Attorney, Agent, or Firm* — Workman Nydegger

(57) ABSTRACT

A method for fabricating or retrofitting a building, the method including: positioning a coil of rebar toward an interior surface of a structure of a building, the structure of the building at least partially bounding a chamber, uncoiling a section of rebar from the coil of rebar; and securing the uncoiled section of rebar to the interior surface of the structure while the uncoiled section of rebar remains connected to the coil of rebar.

24 Claims, 20 Drawing Sheets

(56) References Cited

U.S. PATENT DOCUMENTS

| | | | | | |
|---|---|---|---|---|---|
| 3,277,219 | A | | 10/1966 | Turner | |
| 3,292,338 | A | | 12/1966 | MacClarence et al. | |
| 3,462,521 | A | | 8/1969 | Bini | |
| 3,668,287 | A | | 6/1972 | Mackie | |
| 3,734,670 | A | | 5/1973 | Stickler, Jr. | |
| 3,776,805 | A | | 12/1973 | Hansen | |
| 3,909,992 | A | | 10/1975 | Stachiw | |
| 3,916,662 | A | | 11/1975 | Arnold | |
| 3,918,233 | A | | 11/1975 | Simpson | |
| 3,924,363 | A | | 12/1975 | Candle | |
| RE28,689 | E | | 1/1976 | Turner | |
| 3,968,604 | A | | 7/1976 | Hills | |
| 3,996,320 | A | | 12/1976 | Bini | |
| 4,048,825 | A | | 9/1977 | Dastrup et al. | |
| 4,077,177 | A | | 3/1978 | Boothroyd et al. | |
| 4,102,956 | A | | 7/1978 | Heifetz | |
| 4,155,967 | A | * | 5/1979 | South | E04B 1/3211 264/45.2 |
| 4,170,093 | A | * | 10/1979 | Cappellini | E04G 11/04 264/32 |
| 4,324,074 | A | * | 4/1982 | South | E04B 1/3505 264/45.2 |
| 4,442,059 | A | | 4/1984 | Boyce | |
| 4,550,544 | A | | 11/1985 | Thoeny | |
| 4,567,696 | A | | 2/1986 | Malet | |
| 4,723,751 | A | | 2/1988 | Hale | |
| 4,788,803 | A | | 12/1988 | Seitz | |
| 5,007,212 | A | | 4/1991 | Fritts et al. | |
| 5,094,044 | A | * | 3/1992 | Dykmans | E04G 11/36 427/508 |
| 5,134,830 | A | * | 8/1992 | Dykmans | E04G 11/36 52/249 |
| 5,163,360 | A | | 11/1992 | Petz | |
| 5,177,919 | A | * | 1/1993 | Dykmans | E04C 5/18 52/297 |
| 5,188,690 | A | | 2/1993 | Daussan et al. | |
| 5,479,743 | A | | 1/1996 | Queen et al. | |
| 5,487,400 | A | | 1/1996 | Dawkins | |
| 5,579,609 | A | | 12/1996 | Sallee | |
| 5,617,754 | A | | 4/1997 | Senft et al. | |
| 5,918,438 | A | | 7/1999 | South | |
| 5,950,512 | A | | 9/1999 | Fields | |
| 6,089,493 | A | * | 7/2000 | Moore | B21F 17/00 242/418.1 |
| 6,260,306 | B1 | | 7/2001 | Swetish et al. | |
| 6,840,013 | B2 | * | 1/2005 | South | E04B 1/3211 52/80.1 |
| 7,722,293 | B2 | * | 5/2010 | Kruse | E02D 17/04 405/133 |
| 9,493,939 | B2 | | 11/2016 | South et al. | |
| 2009/0051062 | A1 | * | 2/2009 | Wilkinson | B29C 48/15 264/32 |
| 2015/0314348 | A1 | * | 11/2015 | Dani | B21D 3/02 72/13.1 |
| 2017/0321438 | A1 | | 11/2017 | South, Jr. | |
| 2021/0381262 | A1 | * | 12/2021 | Miksa | E04G 11/045 |

FOREIGN PATENT DOCUMENTS

| | | | |
|---|---|---|---|
| SU | 610964 | A1 | 6/1978 |
| WO | 2004/025040 | A2 | 3/2004 |
| WO | 2023/283180 | | 1/2023 |

OTHER PUBLICATIONS

Genie, A Trex Brand Brochure, *Reach and Reliability Genie Boom Lifts*, 2019, pp. 1-32.

International Search Report and Written Opinion dated Oct. 31, 2024, issued in PCT Application No. PCT/US2024/035614, filed Jun. 26, 2024.

* cited by examiner

METHODS AND APPARATUS FOR FABRICATING AND RETROFITTING DOME SHAPED BUILDINGS USING COILED REBAR

CROSS-REFERENCE TO RELATED APPLICATIONS

This application claims the benefit of U.S. Provisional Application No. 63/510,210, filed Jun. 26, 2023, which is incorporated herein by specific reference.

BACKGROUND OF THE INVENTION

1. The Field of the Invention

The present invention relates to methods and apparatus for fabricating and retrofitting dome shaped buildings using coiled rebar.

2. The Relevant Technology

The use of freestanding dome shaped buildings is becoming increasingly popular. In contrast to conventional rectangular buildings, dome shaped buildings have a large interior space which is free from obstructions such as columns or other supports. Conventional dome structures are formed by inflating a flexible liner, applying a stabilizing layer on an interior surface of the liner, forming a reinforcing mat of rebar interior of the flexible liner, and then applying shotcrete over the reinforcing mat. Once the shotcrete is cured, the dome is self-supporting.

Although dome shaped buildings have many advantages, forming the reinforcing mat can be expensive, time consuming and labor intensive. For example, the reinforcing mat is typically formed by overlaying pre-cut lengths of rebar adjacent to the stabilizing layer and then tying them together with wire. The pre-cut lengths of rebar are commonly in a range between 6 meters and 12 meters. In some applications, the rebar must be custom cut to specific lengths for proper placement and fitting. The custom cutting, storing, and tracking of different lengths of rebar is expensive and time consuming. In turn, it takes multiple people to handle the pre-cut rebar sections and move them to the desired position for placement. In addition, by using pre-cut rebar sections, which can number in the hundreds or thousands for large projects, it is necessary to overlap and tie together opposing ends of separate rebar sections to form continuous lengths. The required overlapping of the rebar results in additional material cost. Furthermore, the movement, placement, and tying of the rebar sections is expensive, time consuming, and labor intensive. In addition, the rebar is weakest where it is tied together. As such, by using multiple pre-cut rebar sections that must be tied together, additional rebar and/or larger rebar must be used to compensate for the extensive tying. Additional problems also exist.

Accordingly, what is needed in the art are methods and apparatus for fabricating dome and other shaped buildings that solve one or more of the above problems associated with forming of the reinforcing mat.

SUMMARY OF THE DISCLOSURE

A first independent aspect of the disclosure includes a method for fabricating or retrofitting a building that includes:

positioning a coil of rebar toward an interior surface of a structure of a building, the structure of the building at least partially bounding a chamber;

uncoiling a section of rebar from the coil of rebar; and securing the uncoiled section of rebar to the interior surface of the structure while the uncoiled section of rebar remains connected to the coil of rebar.

In one embodiment, the structure includes an outer perimeter wall of a preexisting building.

In an alternative embodiment, the preexisting building is a storage silo.

In another embodiment, at least a portion of the interior surface of the outer perimeter wall has a dome or cylindrical configuration.

In another embodiment, the structure includes a stabilizing layer disposed on at least a portion of an interior surface of an inflated form.

Another embodiment includes, spraying a cementitious material over the uncoiled section of rebar secured to the structure.

In another embodiment, the coil of rebar comprises a single, continuous strand of rebar having an uncoiled linear length of at least 50 meters, 100 meters, 250 meters, 500 meters, 1,000 meters, 1,500 meters, 2,000 meters, 2,500 meters or 3,000 meters.

In another embodiment, the uncoiled section of rebar secured to the structure has a linear length of at least 20 meters, 50 meters, 100 meters, 250 meters, 500 meters, 1,000 meters, or 1,500 meters and the coil of rebar has a uncoiled linear length of at least 20 meters, 50 meters, 100 meters, 250 meters, 500 meters, 1,000 meters, or 1,500 meters.

In another embodiment, the uncoiled section of rebar and the coil of rebar comprise a single, unitary, continuous strand of rebar.

In another embodiment, the coil of rebar comprises a single, unitary, continuous strand of rebar coiled into a coil, the coil having a maximum diameter of at least 1 meter, 1.3 meters, 1.6 meters, 2 meters or 2.5 meters.

In another embodiment, the coil of rebar comprises a continuous strand of rebar, the continuous strand of rebar having a nominal diameter of at least 9 mm, 11 mm, 13 mm, 15 mm, 17 mm, 19 mm, or 21 mm.

In another embodiment, the inflated form comprises a flexible, foldable, sheet, at least a portion of the inflated form having a dome or cylindrical shaped configuration when inflated.

In another embodiment, the method includes forming the structure by spraying one or more layers of a material on an interior surface of an inflated form.

In another embodiment, the material being sprayed comprises a polymeric foam.

In another embodiment, the method includes connecting a secondary rebar to rebar hangers extending from the structure, wherein securing the uncoiled section of rebar to the structure comprises securing the uncoiled section of rebar directly to the secondary rebar.

In another embodiment, connecting the secondary rebar to the rebar hangers comprises:

securing supporting strands of rebar to the rebar hangers so that the supporting strands of rebar are substantially horizontally disposed; and securing reinforcing strands of rebar to the supporting strands of rebar so that the reinforcing strands of rebar are substantially vertically disposed and cross over the supporting strands of rebar, wherein the uncoiled section of rebar is secured directly to the reinforcing strands of rebar so that the uncoiled section of rebar is substantially horizontally disposed.

In another embodiment, the step of uncoiling the section of rebar from the coil of rebar comprises:

positioning the coil of rebar on a basket assembly that is supported by an arm of a mechanical lift located within the chamber; and rotating the coil of rebar positioned on the basket so as to uncoil the section of rebar.

Another embodiment includes raising the basket assembly having the coil of rebar positioned thereon to an elevated position adjacent to the structure of the building before rotating the coil of rebar for uncoiling.

Another embodiment includes moving the basket assembly relative to the structure while concurrently rotating the coil of rebar positioned on the basket assembly so as to uncoil the section of rebar while the basket assembly is moving.

In another embodiment, rotating the coil of rebar comprises:

mounting the coil of rebar on a motor driven, coiled-rebar dispenser disposed on the basket assembly; and activating the coiled-rebar dispenser so as to rotate the coil of rebar and uncoil the section of rebar.

In another embodiment, the mechanical lift and the coiled-rebar dispenser are each electrically coupled to a controller, the controller being programmed to automatically correlate movement of the basket assembly by the mechanical lift with rotation of the coil of rebar by the coiled-rebar dispenser.

Another embodiment includes passing the uncoiled section of rebar through a rebar straightener before securing the uncoiled section of rebar to the structure.

In another embodiment, the rebar straightener is disposed on the basket assembly.

In another embodiment, the step of passing the uncoiled section of rebar through the rebar straightener comprises passing the uncoiled section of rebar between a first pair of wheels and then between a second pair of wheels, the wheels straightening the uncoiled section of rebar to a desired extent.

In another embodiment, the coil of rebar has a central axis of rotation about which the coil of rebar rotates while the section of rebar is uncoiled from the coil of rebar, the coil of rebar being disposed on the coiled-rebar dispenser so that the axis of rotation is either substantially vertical or substantially horizontal as the coil of rebar is rotated.

In another embodiment, the basket assembly includes:

a base support secured to the arm of the mechanical lift; and a platform pivotably mounted to the base support, the coiled-rebar dispenser and coil of rebar being disposed on the platform.

In another embodiment, the basket assembly further includes a deck supported on the platform, the deck being configured to receive and support one or more operators, wherein the deck can swivel relative to the platform.

Another embodiment further includes:

rotating the coil of rebar to uncoil further sections of rebar from the coil of rebar; and securing the further sections of rebar to the stabilizing layer while the further sections of rebar remain secured to the coil of rebar.

A second independent aspect of the present disclosure includes a system for dispensing coiled rebar, the system including:

a basket assembly configured for being lifted off of a ground surface by a mechanical lift, the basket assembly comprising:

a deck configured for supporting one or more operators;

a coiled-rebar dispenser comprising a rotatable spindle configured to removably receive a coil of rebar; and a rebar straightener.

In another embodiment, the rebar straightener comprises a first set of rotatable wheels and a spaced apart second set of rotatable wheels, the rebar straightener being configured to straighten a strand of rebar to a desired extent as the rebar is passed between the first set of rotatable wheels and the second set of rotatable wheels.

Another embodiment further includes a mechanical lift having an elongated arm, the basket being disposed on the arm, the mechanical lift being configured to raise, lower, and laterally move the arm.

In another embodiment, the elongated arm is a telescoping arm that selectively expands and contracts.

In another embodiment, the mechanical lift is a boom lift or a cherry picker lift.

Another embodiment includes a controller electrically coupled to the mechanical lift and the coiled-rebar dispenser, the controller being programmed to automatically correlate movement between the mechanical lift and the coiled-rebar dispenser.

Another embodiment further includes a controller electrically coupled to the mechanical lift, the coiled-rebar dispenser, and the rebar straightener, the controller being programmed to automatically correlate movement of the mechanical lift and the coiled-rebar dispenser with operation of the rebar straightener.

Another embodiment further includes a coil of rebar disposed on the rotatable spindle of the coiled-rebar dispenser, the coil of rebar comprising a single, continuous strand of rebar having an uncoiled linear length of at least 50 meters, 100 meters, 150 meters, 200 meters, or 250 meters.

Another embodiment further includes a safety rail upstanding and encircling around at least a portion of the deck.

In another embodiment, the basket assembly further includes:

a base support configured for securing to the mechanical lift; and a platform pivotably mounted to the base support, the coiled-rebar dispenser and rebar straightener being disposed on the platform.

In another embodiment, the deck is supported on the platform, wherein the deck can swivel relative to the platform.

In another embodiment, the platform pivots about a first axis of rotation and the deck swivels about a second axis of rotation, the first axis of rotation being orthogonal to the second axis of rotation.

A third independent aspect of the present disclosure includes a building structure having:

an outer structure having an interior surface that bounds a chamber, at least a portion of the interior surface having a dome or cylindrical configuration;

a single, unitary, continuous strand of rebar secured adjacent to the interior surface of the outer structure, the continuous strand of rebar having a length of at least 50 meters; and cementitious material applied over the entire length of the continuous strand of rebar.

In another embodiment, the single, unitary, continuous strand of rebar completely encircles the chamber bounded by the outer structure.

In another embodiment, the single, unitary, continuous strand of rebar continuously encircles the chamber bounded by the outer structure at least 2, 5, 10, or 20 times.

In another embodiment, the length of the single, unitary, continuous strand of rebar is at least 100 meters, 250 meters, 500 meters, 1,000 meters, 1,500 meters, 2,000 meters, 2,500 meters or 3,000 meters.

In another embodiment, the continuous strand of rebar extends substantially horizontally along the interior surface of the outer structure.

In another embodiment, the continuous strand of rebar extends horizontally or in a helical pattern along the interior surface of the outer structure so as to completely encircle the chamber at least once.

In another embodiment, the outer structure comprises a layer of polymeric foam having the interior surface and having an opposing exterior surface.

In another embodiment, a sheet of flexible and foldable material that is at least substantially impermeable to gas is disposed on the exterior surface of the layer of polymeric foam.

In another embodiment, the outer structure has a dome or cylindrical configuration.

In another embodiment, the building is a storage silo.

A fourth independent aspect of the present disclosure includes a method for forming a building, the method including:

- forming an outer structure of the building, the outer structure having an interior surface;
- raising a coil of rebar to an elevated position that is adjacent to the interior surface of the outer structure of the building;
- rotating the coil of rebar raised to the elevated position so as to uncoil a section of the coil of rebar; and
- securing the uncoiled section of the coil of rebar to the interior surface of the outer structure while the uncoiled section of the coil of rebar remains connected to the coil of rebar.

In one embodiment, raising the coil of rebar comprises:

- mounting the coil of rebar on a motor driven, coiled-rebar dispenser, the coiled-rebar dispenser being located on a basket assembly of a mechanical lift; and
- raising the basket assembly having the coil of rebar disposed thereon to the elevated positioned adjacent to the interior surface of the outer structure of the building by use of the mechanical lift.

In an alternative embodiment, rotating the coil of rebar comprises activating the coiled-rebar dispenser so as to rotate the coil of rebar and uncoil the section of the coil of rebar.

Another embodiment includes moving the basket assembly by use of the mechanical lift while the section of rebar is concurrently being uncoiled from the coil of rebar.

Another embodiment includes:

- continue rotating the coil of rebar to uncoil further sections of the rebar from the coil of rebar; and
- securing the further sections of the rebar to the interior surface of the outer structure at spaced apart locations while the further sections remain secured to the coil of rebar.

In another embodiment, the mechanical lift and the coiled-rebar dispenser are each electrically coupled to a common controller, the controller automatically correlating movement of the basket assembly by the mechanical lift and uncoiling of the rebar from the coil of rebar.

Another embodiment includes passing the uncoiled section of rebar through a rebar straightener before securing the uncoiled section of rebar to the interior surface of the outer structure.

In another embodiment, the step of forming the outer structure comprises:

- inflating a form so that an interior surface of the inflated form at least partially bounds a chamber; and
- forming a stabilizing layer on at least a portion of the interior surface of the inflated form.

A fifth independent aspect of the present disclosure includes a method for forming a building, the method including:

- inflating a form so that an interior surface of the inflated form at least partially bounds a chamber;
- forming a stabilizing layer on at least a portion of the interior surface of the inflated form;
- uncoiling a section of rebar from a coil of rebar; and
- securing the uncoiled section of rebar to the stabilizing layer while the uncoiled section of rebar remains connected to the coil of rebar.

The present disclosure envisions that each of the alternative embodiments associated with the corresponding independent aspect can be combined in any desired combination and that each of the alternative embodiments associated with one independent aspect can also be combined in any desired combination with the other indent aspects.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
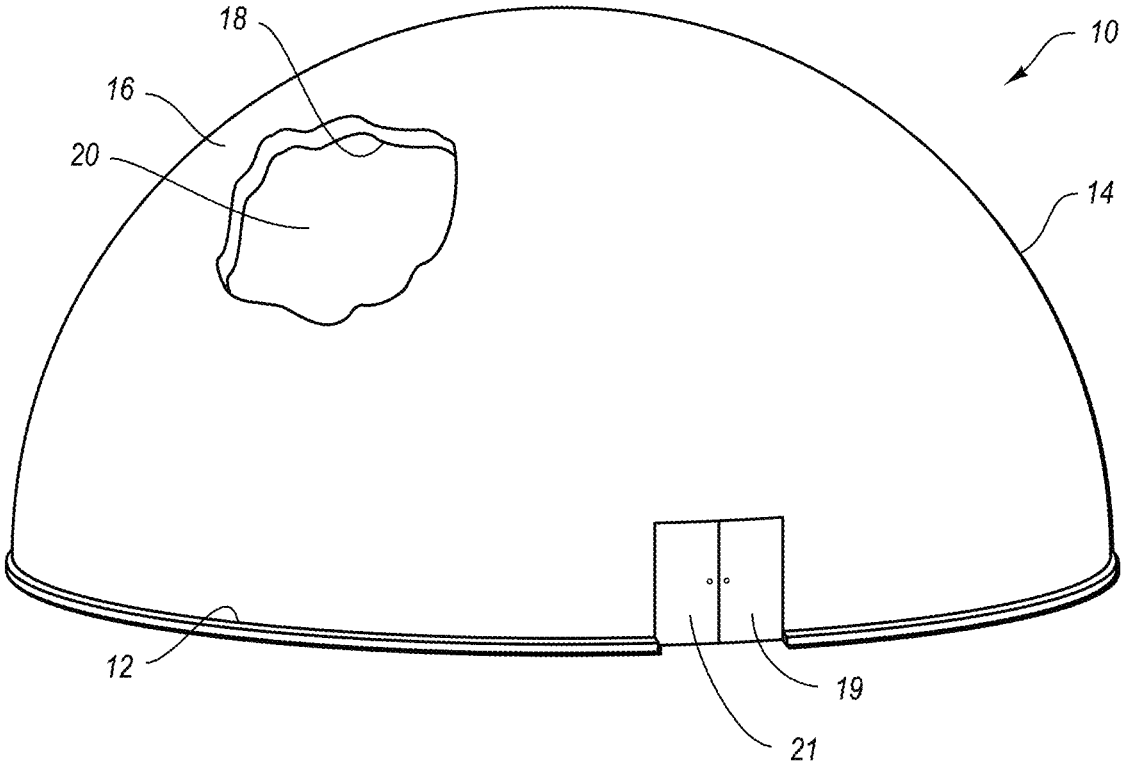
FIG. 1 is a perspective view of one embodiment of a dome shaped building.

Before describing the present disclosure in detail, it is to be understood that this disclosure is not limited to particularly exemplified apparatus, systems, assemblies, methods, or process parameters that may, of course, vary. It is also to be understood that the terminology used herein is only for the purpose of describing particular exemplary embodiments of the present disclosure and is not intended to limit the scope of the disclosure in any manner.

All publications, patents, and patent applications cited herein, whether supra or infra, are hereby incorporated by reference in their entirety to the same extent as if each individual publication, patent, or patent application was specifically and individually indicated to be incorporated by reference.

The term "comprising" which is synonymous with "including," "containing," or "characterized by," is inclusive or open-ended and does not exclude additional, unrecited elements or method steps.

It will be noted that, as used in this specification and the appended claims, the singular forms "a," "an" and "the" include plural referents unless the content clearly dictates otherwise. Thus, for example, reference to a "rebar coil" includes one, two, or more rebar coils.

In addition, unless otherwise indicated, numbers expressing quantities, constituents, distances, or other measurements used in the specification and claims are to be understood as optionally being modified by the term "about" or its synonyms. When the terms "about," "approximately," "substantially," or the like are used in conjunction with a stated amount, value, or condition, it may be taken to mean an amount, value or condition that deviates by less than 20%, less than 10%, less than 5%, less than 1%, less than 0.1%, or less than 0.01% of the stated amount, value, or condition.

As used in the specification and appended claims, directional terms, such as "top," "bottom," "left," "right," "up," "down," "upper," "lower," "proximal," "distal" and the like are used herein solely to indicate relative directions and are not otherwise intended to limit the scope of the disclosure or claims.

Where possible, like numbering of elements have been used in various figures. Furthermore, multiple instances of an element and or sub-elements of a parent element may each include separate letters appended to the element number. For example, two instances of a particular element "10" may be labeled as "10A" and "10B". In that case, the element label may be used without an appended letter (e.g., "10") to generally refer to all instances of the element or any one of the elements. Element labels including an appended letter (e.g., "10A") can be used to refer to a specific instance of the element or to distinguish or draw attention to multiple uses of the element. Furthermore, an element label with an appended letter can be used to designate an alternative design, structure, function, implementation, and/or embodiment of an element. For example, two alternative exemplary embodiments of a particular element may be labeled as "10A" and "10B". In that case, the element label may be used without an appended letter (e.g., "10") to generally refer to all instances of the alternative embodiments or any one of the alternative embodiments.

Various aspects of the present devices and assemblies may be illustrated by describing components that are coupled, attached, and/or joined together. As used herein, the terms "coupled", "attached", and/or "joined" are used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements present. Furthermore, as used herein, the terms "connection," "connected," and the like do not necessarily imply direct contact between the two or more elements.

Various aspects of the present devices, assemblies, and methods may be illustrated with reference to one or more exemplary embodiments. As used herein, the terms "embodiment," "alternative embodiment" and "exemplary embodiment" mean "serving as an example, instance, or illustration," and should not necessarily be construed as required or as preferred or advantageous over other embodiments disclosed herein.

Unless defined otherwise, all technical and scientific terms used herein have the same meaning as commonly understood by one of ordinary skill in the art to which the present disclosure pertains. Although a number of methods and materials similar or equivalent to those described herein can be used in the practice of the present disclosure, the preferred materials and methods are described herein.

I. Introduction

Depicted in FIG. 1 is one embodiment of an inventive building 10 incorporating features of the present disclosure. In general, building 10 comprises an annular footing 12 on which a dome shaped boundary wall 14 is formed. Boundary wall 14 has an exterior surface 16 and an interior surface 18. Interior surface 18 bounds a chamber 20. Chamber 20 is accessible through an entrance 19 which typically extends through boundary wall 14 and is selectively blocked by doors 21. If desired, a shelter can be formed on the exterior of building 10 so as to cover entrance 19.

Figure 2:
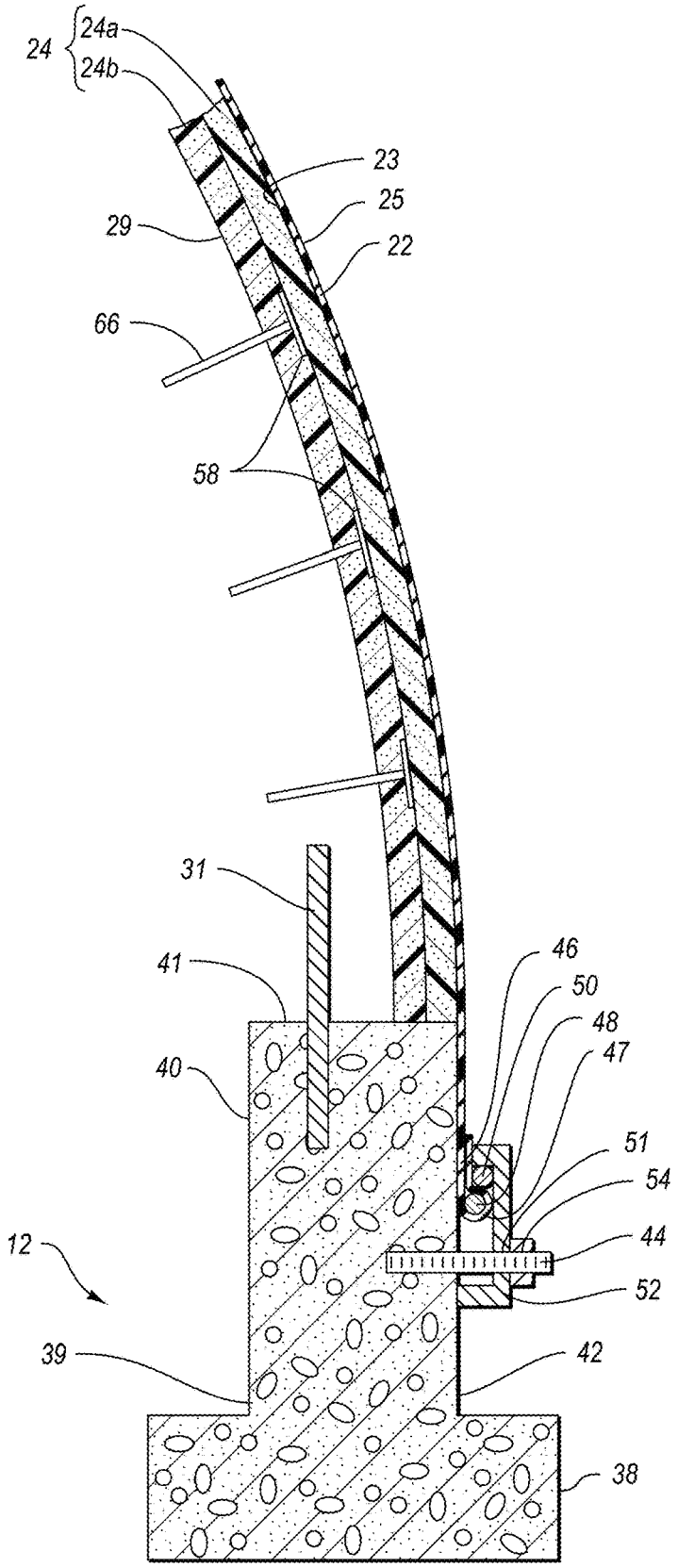
FIG. 2 is a cross sectional side view of a portion of the building shown in FIG. 1 in a partially assembled state.

Briefly stated, in one method of production, building 10 is constructed by first forming footing 12. With reference to FIG. 2, an inflatable form 22 is then secured to footing 12 in air-tight relation therewith. Form 22 is then inflated by blowing air into chamber 20 bounded by form 22. Once form 22 is inflated, one or more stabilizing layers are applied against an interior surface of form 22. In one embodiment, the stabilizing layer(s) comprises a polymeric foam which can be sprayed onto form 22.

Mounted on the interior surface of the one or more stabilizing layers is a reinforcing mat of rebar which can be comprised of vertically orientated rebar and horizontally orientated rebar. More specifically, in one method of formation, strands of rebar are secured so as to extent vertically along the interior surface of the one or more stabilizing layers. Next, large coils of rebar are progressively uncoiled and secured to the vertical strands so as to be horizontally or substantially horizontally disposed. By securing coils of rebar (as opposed to short sections of rebar) to the vertical rebar, the rate of application of the rebar is significantly increased while simultaneously increasing the effective strength of the rebar. As discussed further below, other advantages also exist.

Once the matt of rebar is secured, one or more support layers are then applied over the interior surface of the stabilizing layer such that the reinforcing mat is embedded therein. In one embodiment, the one or more support layers is typically formed of a cementitious material such as a sprayable concrete or shotcrete. As needed, the process of applying a matt of rebar and then covering the matt of rebar with a stabilizing layer can then be repeated one or more times until the desired structural strength for the building is achieved.

Outlined below are more detailed descriptions and alternative methods for manufacturing concrete structures, such as building 10, which can incorporate domed features. Although the methods are primarily discussed with reference to the manufacture of annular domed shaped buildings, such as shown in FIG. 1, it is appreciated that substantially the same methods can be used in the manufacture of other types and shapes of structures which incorporate dome or cylindrical features. For example, methods of the present disclosure can also be used in forming buildings having an elongated domed or cylindrical configuration or buildings that include a segment of a dome or cylindrical configuration. The methods can also be used in other building designs having an interior surface that forms a continuous loop. In one embodiment, the building can be a storage silo, such as having a domed or cylindrical configuration.

II. Footing

Footing 12 provides a foundation for building 10 and defines an outer perimeter thereof. In one embodiment, as depicted in FIG. 2, footing 12 can comprise an outwardly extending base portion 38 and a wall portion 40 upwardly extending therefrom. Wall portion 40 has an interior surface 39, a top surface 41, and an exterior surface 42. A plurality of spaced apart bolts 44 are partially embedded within wall portion 40 so as to radially outwardly project from exterior surface 42 thereof. In one embodiment, bolts 44 are typically spaced apart in a range between 25 cm to 100 cm around footing 12. Other spacing can also be used based on building parameters. As will be discussed below in greater detail, bolts 44 are used to secure inflatable form 22 to footing 12.

Also partially embedded within footing 12 so as to upwardly project from top surface 41 of wall portion 40 are a plurality of spaced apart reinforcing rods 31. As will be discussed below in greater detail, reinforcing rods 31 are used to facilitate a rigid connection between footing 12 and boundary wall 14. Reinforcing rods 31 typically comprise conventional steel rebar although other conventional reinforcing materials can also be used. Reinforcing rods 31 are typically spaced apart in a range between 25 cm to 100 cm, although other spacing can also be used based on building parameters.

Footing 12 is typically comprised of poured concrete having reinforcing embedded therein. In the embodiment shown, footing 12 has an inverted substantially T-shaped transverse cross section. In alternative embodiments, footing 12 can have any desired transverse cross section that satisfies the building parameters. For example, footing 12 should be dimensioned to withstand frost conditions and be designed in accordance with the size of the building and the weight bearing capacity of the underlying soil.

As previously mentioned, footing 12 outlines the perimeter or footprint for building 10. In one embodiment, footing 12 is placed in a circular path. In alternative embodiments, as will be discussed below with regard to final building designs, footing 12 can also be placed in a variety of other configurations such as oval, elliptical, polygonal, irregular, or combinations thereof.

In one embodiment, wall portion 40 of footing 12 may be placed completely underground or project a few feet above the ground surface. In alternative embodiments, wall portion 40 can vertically extend so as to form a wall around the base of building 10. For example, wall portion 40 can have a height of at least 0.5 meters, 1 meter, 2 meters, 3 meters, 4 meters, 6 meters, 8 meters, 10 meters, or be in in a range between any two of the foregoing. In this embodiment, entrance 19 (FIG. 1) to building 10 can be formed through wall portion 40.

It is generally desirable that prior to securing inflatable form 22 to footing 12, all equipment that will be used in the construction of building 10 and which is too large to be moved into the building area through an access, to be described below, be placed within the area of chamber 20 bounded by footing 12. Once the equipment is positioned, form 22 is spread over the equipment and secured to footing 12.

III. Inflatable Form

Figure 3:
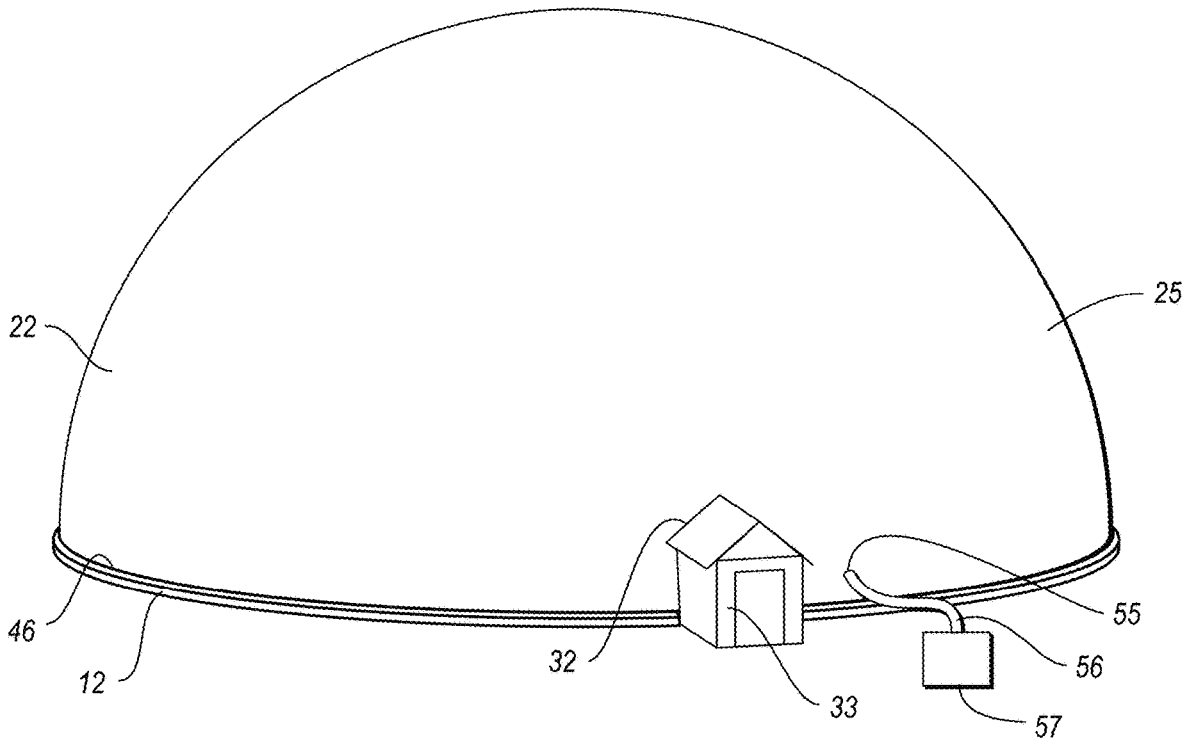
FIG. 3 is a perspective view of an inflated form mounted on a footing used in forming the building of FIG. 1.

As depicted in FIGS. 2 and 3, inflatable form 22 comprises a plurality of flexible, sheet-like panels that have been sewn, seamed, or otherwise secured together such that when mounted on footing 12 and inflated, form 22 forms a substantially dome-shaped surface. Alternatively, inflatable form 22 can be configured so that at least a portion of form 22 forms a dome shaped configuration or forms a portion or section of a dome shaped configuration. Alternatively, form 22 does not need to have or include a dome shaped configuration. For example, inflatable form 22 can form a box, cone, or other configuration.

Form 22 has an interior surface 23 and an exterior surface 25 that each extend to an outer peripheral edge 46. In one embodiment, form 22 is comprised of a lightweight flexible sheet that can be at least substantially or fully impermeable to gas and/or liquid. The sheet can be formed from a cross laminate plastic, a reinforced plastic-coated fabric, such as a polyvinyl chloride impregnated Dacron, or any other suitable material. Furthermore, form 22 can be formed of one or more layers of material. Form 22 can typically be rolled or folded without plastic deformation and will automatically unfold when inflated as disclosed herein. As will become more apparent hereinbelow, form 22 may be reusable or may be left in place after forming building 10.

In one embodiment of the present disclosure, means are provided for securing form 22 to footing 12 in a substantially airtight engagement. By way of example and not by limitation, a loop 47 is formed at peripheral edge 46 of form 22. A line 48, such as a cord or cable, is passed through loop 47 so as to extend along peripheral edge 46. In alternative embodiments, line 48 can be secured to peripheral edge 46 by use of any one of a number of conventional techniques. Peripheral edge 46 having line 48 coupled therewith is positioned against exterior surface 42 of footing 12 so that form 22 covers the area bounded by footing 12.

A sheathed clamping cable 50 is then positioned against exterior surface 25 of form 22 above line 48. Clamping cable 50 is tensioned in a continuous loop so as to bias form 22 against exterior surface 42 of footing 12, thereby preventing line 48 from passing between clamping cable 50 and footing 12. In one embodiment, clamping cable 50 is disposed tightly against line 48.

Once clamping cable 50 is tensioned, a plurality of elongated clamps 52 are mounted to footing 12. Each clamp 52 has a substantially C-shaped transverse cross section with spaced apart apertures 51 formed along the length thereof. Clamps 52 are mounted against footing 12 so as to cover line 48 and clamping cable 50 with bolts 44 extending through apertures 51. A nut 54 is threaded onto the free end of each bolt 44 so as to securely bias each clamp 52 against footing 12. Clamps 52 thus prevent clamping cable 50 and/or line 48 from sliding off of footing 12 during the inflation of form 22.

One alternative embodiment of the means for securing form 22 to footing 12 is depicted in FIG. 2 of U.S. Pat. No. 4,324,074. Disclosure within the '074 patent relating to securing the form to the footing is hereby incorporated by specific reference. It will be appreciated that other embodiments also exist for securing form 22 to footing 12. By way of example and not by limitation, bolts, hooks, clamps, adhesive, welding, and other types of fasteners and methods of fastening can be used to directly secure form 22 to footing 12.

As depicted in FIG. 3, an air port 55 is formed on form 22. A duct 56 provides sealed communication between air port 55 and a blower 57. During operation, blower 57 is activated causing air from the surrounding environment to be blown through duct 56 and air port 55 so as to inflate form 22. As a result of the inflation of form 22, chamber 20 is bounded therein. Air port 55 can also extend through footing 12, a wall formed on footing 12, or any other structure that will enable air to be blown through air port 55 to inflate form 22.

Blower 57 is used to inflate form 22 so that a first air pressure is formed therein. In one embodiment, the first pressure is in a range between about ½ inch (1.25 cm) $H_2O$ to about 2 inches (5 cm) $H_2O$ of static pressure. In other embodiments depending on the weight and size of form 22, other pressures may also be used.

To enable access to chamber 20, a temporary access 32 can be formed on form 22, such as adjacent to air port 55. Mounted in substantially sealed communication with temporary access 32 is an air lock 33. In one embodiment, air lock 33 simply comprises a structure having a first doorway, a second doorway, and a compartment formed therebetween. As people enter and exit chamber 20 through air lock 33, only one of the first and second doorways is open at a time. As a result, air within chamber 20 cannot significantly escape through air lock 33. The pressure within chamber 20 is thus maintained within a desired safety range.

As previously discussed, where wall portion 40 of footing 12 upwardly extends to form a perimeter wall, it is also appreciated that temporary access 32 and/or air port 55 can be formed through wall portion 40 as opposed to through form 22. When building structure 10 is completed, air port 55 and/or temporary access 32 may eventually form entrance 19 or a window or can be sealed closed.

After form 22 is inflated, entrances, windows, and all other openings that are to be present on building 10 are marked on interior surface 23 of inflated form 22. In one embodiment, the various layers of rebar and/or other select layers can be applied so as not to cover the marked openings. As a result, the openings can be more easily cut out once construction of building 10 is completed.

IV. Stabilizing Layer

Returning to FIG. 2, after inflating form 22, a stabilizing layer 24 is applied to interior surface 23 of form 22. Stabilizing layer 24 is generally comprised of a polymeric foam. As used in the specification and appended claims, the term "polymeric foam" is intended to include all polymeric materials that have been expanded in some way so as to form a foam. Examples of polymeric foams include polyurethane foam, styrofoam, and other conventional expandable polymeric foams. The polymeric foam can also comprise additives such as fillers, fibers, or other additives which affect properties such as strength, expansion, setting, finish, and the like. The polymeric foam can be applied through conventional spraying techniques or other conventional processes. Likewise, the polymeric foam can be applied in prefabricated configurations. One common example of a polymeric foam used in the manufacture of stabilizing layer 24 is 1½ $lb/ft^3$ to 2 $lb/ft^3$ polyurethane foam which is sprayed onto form 22. Polymeric foams are beneficial in forming stabilizing layer 24 in that they are relatively light weight, inexpensive, and have good insulative properties. However, in other embodiments, non-polymeric materials, such as cementitious materials, adhesives, or any other types of materials that can be applied and then set to provide structural support, can also be used for stabilizing layer 24. For example, in one alternative embodiment stabilizing layer 24 can be formed from fiber reinforce concrete being applied on form 22. In another alternative, rebar reinforcing can be disposed adjacent to the interior surface of form 22 and a cementitious material, such as shotcrete or other sprayable concrete, can be applied over the rebar reinforcing so as to form stabilizing layer 24.

Although not required, in one embodiment to help ensure that stabilizing layer 24 initially secures to interior surface 23 of form 22 as stabilizing layer 24 is initially applied thereto, a bonding agent is applied in a layer over interior surface 23 of form 22. In one embodiment, the bonding agent comprises an acrylic latex bonding agent such as V-COAT available from Diamond Vogel Paint out of Orange City, Iowa. In other embodiments, the bonding agent can simply comprise as rewettable bonding agent that has adhesive properties when hydrated so as to help stick stabilizing layer 24 to form 22. Use of the bonding agent is most applicable when stabilizing layer 24 is comprised of a cementitious material.

In part, stabilizing layer 24 functions to initially stabilize form 22 and provided a basis on which additional layers can be built. Although not required, the material for stabilizing layer 24 can be selected so as to have insulative properties. In this embodiment, stabilizing layer 24 forms an insulation barrier which helps control the temperature within chamber 20 and prevents the formation of condensation on the interior surface of building 10 bounding chamber 20. The material for stabilizing layer 24 can also be selected so that form 22 can be removed after or during the development of building 10. Alternatively, the material can be selected so that stabilizing layer 24 permanently adheres to form 22.

Depending on the engineering design of building 10, stabilizing layer 24 can be formed as a single layer from a single application. Alternatively, stabilizing layer 24 can be comprised of multiple overlapping sub-layers of the same or different materials. For example, stabilizing layer 24 comprises a first stabilizing sub-layer **24*a* and a second stabilizing sub-layer 24***b*. First stabilizing sub-layer 24*a* and second stabilizing sub-layer 24*b* combine to form a single, substantially inseparable stabilizing layer 24. In yet other embodiments, it is appreciated that stabilizing layer 24 may not be required at all.

Stabilizing layer 24 is applied to inner surface 23 of inflated form 22 by initially spraying first stabilizing sub-layer 24*a* having a thickness in a range between about 1 cm to about 5 cm with about 1 cm to about 3 cm being more common. A plurality of spaced apart hanger 58 are then mounted on sub-layer 24*a*.

Figure 4:
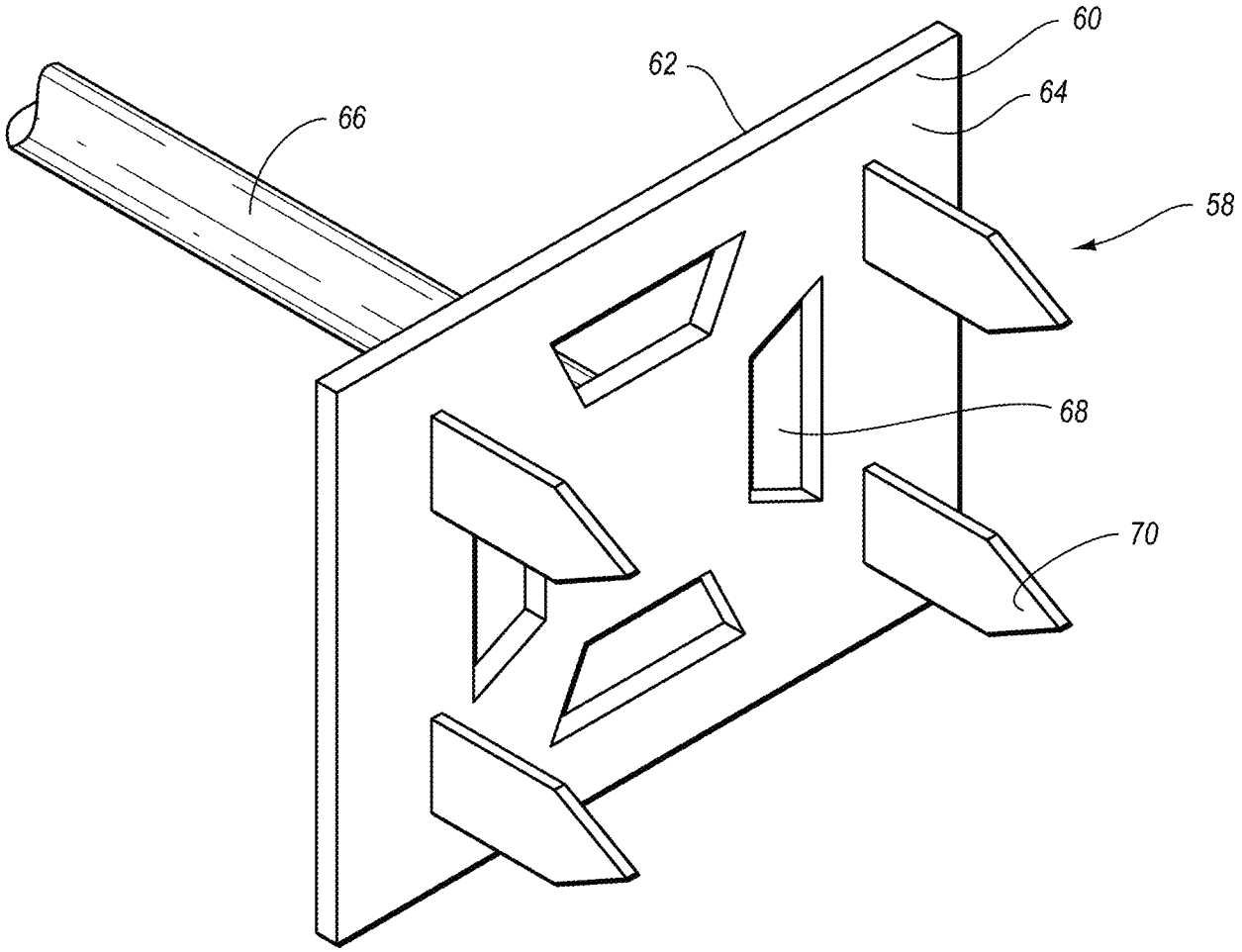
FIG. 4 is a perspective view of a hanger shown in FIG. 2.

As depicted in FIG. 4, each hanger 58 can comprise a planar base plate 60 having a front side 62 and an opposing back side 64. An elongated hanger rod 66 centrally projects from front side 62. Each side of base plate 60 typically has a surface area in a range between about 3 square cm to about 10 square cm. Other dimensions can also be used. Base plate 60 is generally made of a suitable strength metallic sheet such as galvanized sheet steel. A plurality of holes 68 may be formed through base plate 60 so as to reduce the overall weight of each hanger 58 and allow communication therethrough. In an alternative embodiment, base plate 60 can be formed of other materials such as plastic, composites, or other types of metals.

In one embodiment of the present invention, means are provided for securing hangers 58 to stabilizing sub-layer 24*a*. By way of example and not by limitation, outwardly projecting from back side 64 of base plate 60 are a plurality of spaced apart barbs 70. Barbs 70 are configured such that hangers 58 can initially be secured to stabilizing sub-layer 24*a* by simply pushing barbs 70 into stabilizing sub-layer 24*a* until base plate 60 rests against stabilizing sub-layer 24*a*.

In alternative embodiments of the means for securing hangers 58, barbs 70 can be formed with outwardly engaging teeth. In other embodiments, barbs 70 can have a spiral configuration or be replaced with hooks, spikes, adhesive pads, adhesive, and other conventional fasteners. Furthermore, it is appreciated that hangers 58 can be replaced with other hangers or ties used in conventional building practices.

Each hanger rod 66 is generally made of a flexible metal, such as aluminum, and is secured in a generally normal relationship to the plane of the associated base plate 60. Hangers 58 are secured to first stabilizing sub-layer 24*a* such that hanger rods 66 project inwardly from first stabilizing sub-layer 24*a* in substantially normal relation thereto.

Referring again to FIG. 2, once hangers 58 are secured to first stabilizing sub-layer 24*a*, a second stabilizing sub-layer 24*b* is sprayed over stabilizing sub-layer 24*a* so as to embed base plate 60 of hangers 58 therebetween. The now complete stabilizing layer 24 typically has a thickness in a range between 5 cm and 20 cm with between 5 cm and 15 cm being more common. The thickness of stabilizing layer 24 in part depends on the desired amount of insulation. In general, insulative properties increase as stabilizing layer 24 gets thicker. It will be appreciated that first stabilizing sub-layer 24*a* and second stabilizing sub-layer 24*b* may have the same thickness or have different thicknesses. In one example, first stabilizing sub-layer 24*a* and second stabilizing sub-layer 24*b* each have a thickness of at least 3 cm, 4 cm, 5 cm, 6 cm, 8 cm, 10 cm or in a range between any two of the foregoing. In another example, second stabilizing sub-layer 24*b* is at least 1 cm, 2 cm, 3 cm, or 4 cm, thicker than first stabilizing sub-layer 24*a*. Additionally, it will be appreciated that first stabilizing sub-layer 24*a* and second stabilizing sub-layer 24*b* may be comprised of the same material or different material and that they can each be applied as a single layer or as a plurality of overlapping layers. For example, in one embodiment, both sub-layers 24*a* and 24*b* can be comprised of a polymeric foam. In an alternative embodiment, one of sub-layers 24*a* and 24*b* is formed of a polymeric foam while the other is formed a cementitious material, such as fiber reinforced concrete, shotcrete, or other sprayable concrete. In still other embodiments, both sub-layers 24*a* and 24*b* can be formed from a cementitious material without the use of a polymeric foam. Other combinations may also be employed depending on the engineering design and construction needs of building structure 10.

Each hanger rod 66 of hangers 58 has a predetermined length. As such, during the application of second stabilizing sub-layer 24*b*, the operator is able to visually observe the depth of stabilizing sub-layer 24*b* being applied through observing the build-up depth along the length of hanger rods 66. Additionally, the relatively thin hanger rods 66 enable a uniform spraying of polymeric foam about hanger rods 66 without impairing uniformity, density, or layer thickness of the foam. Hanger rods 66 are made long enough to extend outwardly from the completed stabilizing layer 24 by a distance of at least 6 cm, 8 cm, 10 cm, 12 cm, 14 cm, 16 cm, 18 cm or in a range between any two of the foregoing. Other dimensions can also be used. It is also appreciated that markings can be formed along the length of hanger rods 66 so as to assist in forming stabilizing sub-layer 24*b* to a desired depth.

As a result of base plate 60 of hangers 58 being at least partially embedded within stabilizing layer 24, a reinforcing mat, as discussed below, can now be secured to hangers 58 without pulling hanger 58 off of stabilizing layer 24. It is also appreciated that in other embodiments base plate 60 of hangers 58 can be sufficiently secured directly to an interior surface 29 of stabilizing layer 24 so that base plate 60 need not be embedded within stabilizing layer 24. For example, in one embodiment, an adhesive or adhesive pads can be disposed on back side 64 of base plate 60. The adhesive or adhesive pads can then be used to secure hangers 58 directly to interior surface 29 of stabilizing layer 24.

V. Reinforcing Inflatable Form

As stabilizing layer 24 and/or other layers, as discussed below, are formed inward of inflated form 22, the weight of building 10 increases. In some embodiments, depending on the size and configuration of building 10, it is desirable to incrementally increase the air pressure within chamber 20 produced by blower 57 so as to support the increased weight load of the building while the various layers are applied and/or set to reach their supporting strength.

The air pressure, however, cannot be increased beyond the pressure limits of form 22 or, where applicable, the combination of form 22 and stabilizing layer 24. Accordingly, to enable the air pressure within chamber 20 to be safely increased, means are provided for reinforcing form 22 and/or support layer 24. By way of example and not by limitation, in one embodiment the means for reinforcing comprises reinforcing line embedded within stabilizing layer 24. In an alternative embodiment, the means for reinforcing comprises a retention assembly secured over form 22. The reinforcing line and retention assembly are configured to absorb at least a portion of the increased pressure load applied to form 22 and/or stabilizing layer 24. Further disclosure with regard to reinforcing line embedded within stabilizing layer 24 and a retention assembly secured over form 22 are disclosed in U.S. Pat. No. 6,840,013, issued Jan. 11, 2005, and entitled Building with Foam Cored Ribs and Methods which is incorporated herein in its entirety by specific reference.

VI. Reinforcing Mat

Figure 5:
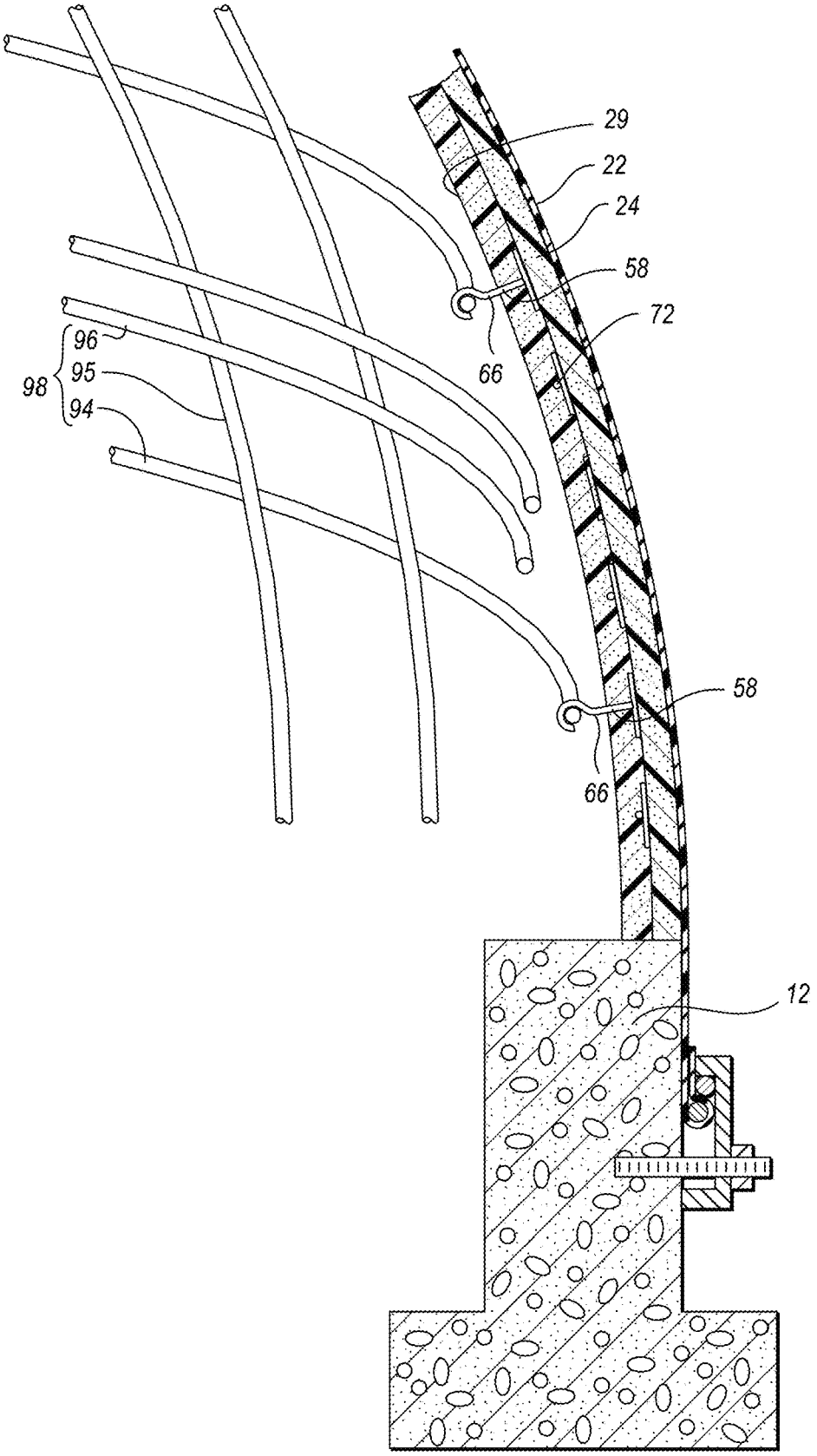
FIG. 5 is the cross sectional side view of the partially assembled building shown in FIG. 2 having a reinforcing mat secured thereto.

As depicted in FIG. 5, once stabilizing layer 24 is complete, a reinforcing mat 98 is secured adjacent to interior surface 29 of stabilizing layer 24. Reinforcing mat 98 typically comprises interconnected strands of conventional rebar. In the depicted embodiment, reinforcing mat 98 comprises support strands 94, first reinforming strands 95, and second reinforcing strands 96. Support strands 94 are generally horizontally disposed in rows that are vertically spaced apart. First reinforcing strands 95 are connected to support strands 94 and generally extend vertically between footing 12 to or toward a top end of building 10 while being disposed in rows that are laterally spaced apart. Finally, second reinforcing strands 96 are connected to first reinforcing strands 95 and generally extend horizontally while being disposed in rows that are vertically spaced apart. As used in the specification and appended claims, support strands 94, first reinforming strands 95, or the combination thereof can be referred to as "secondary rebar" that is used to support second reinforcing strands 96. Furthermore, as discussed below, second reinforcing strands 96 can be formed as one or more single, continuous strands of rebar that are uncoiled from a coil of rebar. Strands 94-96 are typically secured together at their overlapping intersections by using conventional rebar tying techniques. For example, they are commonly secured together using metal tie wire, such as steel wire, that is applied manually or, more commonly, through the use of a conventional rebar tying tool.

More specifically, in one method for forming reinforcing mat 98, support strands 94 are first applied horizontally adjacent to and/or slightly spaced out from interior surface 29 of stabilizing layer 24 and are secured in place by being attached to hangers 58. That is, hanger rods 66 projecting from stabilizing layer 24 are bent around or are otherwise used to secure horizontal disposed support strands 94 in place. Although support strands 94 can be positioned directly against or adjacent to stabilizing layer 24, in one embodiment hangers 58 are used to secure support strands 94 at a spaced apart distance from stabilizing layer 24. As a result, as will be discussed below in greater detail, support strands 94/reinforcing mat 98 can be embedded within a support layer that is applied thereon.

Horizontal rows of support strands 94 are vertically spaced apart at locations between footing 12 and a top end of building 10. Although support strands 94 provide structural reinforcing, one of their functions is to provide a structure that supports first reinforcing strands 95 and second reinforcing strands 96. In this regard, support strands 94 are typically vertically spaced apart at a greater distance than what second reinforcing strands 96 are typically spaced. For example, rows of support strands 94 are typically vertically spaced apart by a distance between 20 cm and 60 cm with between 30 cm and 60 cm being more common. Other dimensions can also be used depending on the application. Depending on the size and shape of the building or structure being formed, support strands 94 are typically comprised of precut sections of rebar typically have a length in a range between 5 meters and 15 meters with between 7 meters and 12 meters being more common. Other dimensions can also be used depending on the application. The precut sections of rebar are lifted and then secured in place by hangers 58, as discussed above. Opposing ends of adjacent precut sections of rebar are overlapped and secured together by conventional rebar tying. The process continues on a single row of rebar sections connected end to end until a continuous loop or row is formed. A vertically spaced apart second row is then formed using the same process and so forth until all desired vertically spaced apart horizontal rows of reinforcing strands 96 are formed that are necessary to support first reinforming strands 95 and second reinforcing strands 96.

Next, first reinforcing strands 95 are mounted on support strands 94. The size and spacing of first reinforcing strands 95 depends, in part, on the size, configuration, and load capacity of the building and the amount of reinforcing needed. First reinforcing strands 95 also typically comprise precut sections of rebar having the same lengths as previously discussed above with regard to support strands 94. The precut sections of rebar are connected end to end in a generally vertical orientation with the adjacent ends being overlapped and secured together using conventional tying techniques. First reinforcing strands 95 can form a continuous arch that extends from footing 12, to a top end of the building/structure, and then back down to footing 12 at the opposing side of the building/structure or at some other location. In other embodiments, first reinforcing strands 95 may only extend from footing 12 to an upper end of the building/structure. However, the diameter of domes decreases with vertical elevation. As such, fewer first reinforcing strands 95 are needed at higher elevations to maintain general uniform spacing between adjacent first reinforcing strands 95. As such, first reinforcing strands 95 need not extend continuously from footing 12 to the top of the building/structure. Rather, the number and/or spacing between first reinforcing strands 95 can be staggered at different elevations. Other configurations and placement of first reinforcing strands 95 can also be used.

Figure 6:
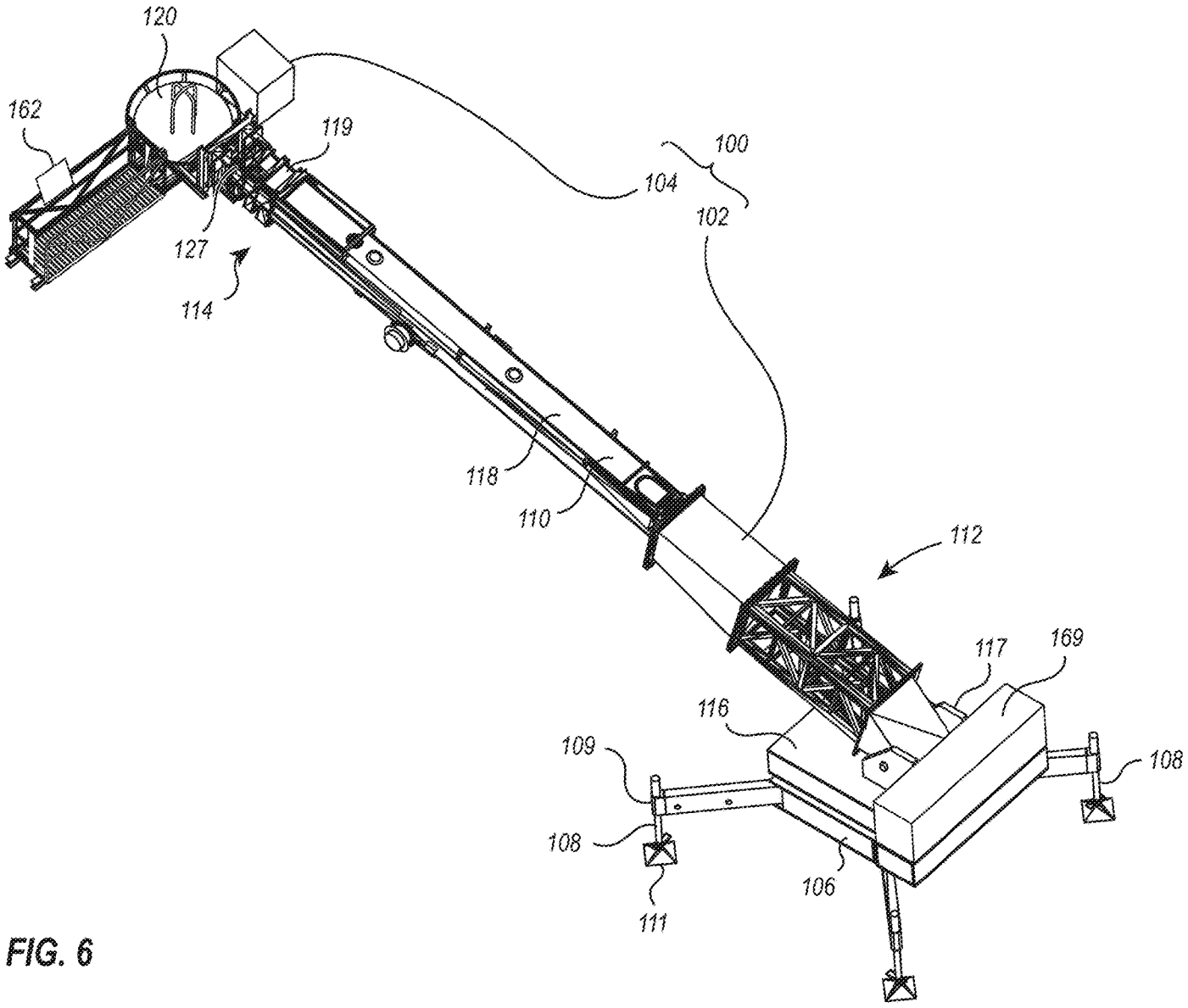
FIG. 6 is a perspective view of a coiled rebar mounting assembly used in mounting the reinforcing mat shown in FIG. 5.

After mounting of first reinforcing strands 95, second reinforcing strands 96 are positioned and secured to first reinforcing strands 95. The size and spacing of second reinforcing strands 96 are again dependent in part on the size, configuration, load capacity, and other properties of the building. However, in contrast to support strands 94 and first reinforcing strands 95 which are typically comprised of precut sections of rebar typically having a length shorter than 15 meters, second reinforcing strands 96 can be applied to first reinforcing strands 95 as one or more continuous strand of rebar having a length of at least 50 meters, 100 meters, 250 meters, 500 meters, 1,000 meters, 1,500 meters, 2,000 meters, 2,500 meters or 3,000 meters or in a range between any two of the foregoing. Other lengths can also be used. The continuous second reinforcing strands 96 can be produced and mounted by progressively uncoiling a coil of rebar while concurrently securing the uncoiled rebar to first reinforcing strands 95. For example, depicted in FIG. 6 is one embodiment of a coiled rebar mounting assembly 100 incorporating features of the present disclosure. Coiled rebar mounting assembly 100 includes a mechanical lift 102 having a basket assembly 104 mounted thereon. In one embodiment, mechanical lift 102 can be uniquely configured as shown in FIG. 6. In alternative embodiments, mechanical lift 102 can comprise a cherry picker lift or a boom lift, such as a telescopic boom lift. Other types of lifts can also be used.

In the depicted embodiment, mechanical lift 102 comprises a base 106 having supports 108 extending therefrom. Each support 108 can comprise an adjustable leg 109 terminating at an enlarged foot 111 disposed on a floor/ground surface. Legs 109 are typically adjustable to enable leveling of base 106. Feet 111 are typically securely fixed to the floor/grounds surface, such as by using bolts, fasteners, clamps, or other anchors. By securing feet 111/legs 109 to the floor/grounds surface, mechanical lift 102 can have minimal size/weight but still be able to lift large weights without tipping or sliding. For example, in one embodiment, the floor/ground surface can be a concrete floor to which feet 111 are removably secured to using anchors, such as those discussed above. In other embodiments, depending on use, supports 108 can comprise wheels for use in supporting and/or moving mechanical lift 102.

Disposed on base 106 is an elongated arm assembly 110 having a first end 112 supported on base 106 and an opposing second end 114 having basket assembly 104 mounted thereon. More specifically, in one embodiment mechanical lift 102 also comprises a turntable 116 that is rotatably mounted on base 106. Turntable 116 can rotate horizontally about a vertical axis extending through base 106 over an angle of at least 180°, 270° or more commonly over 360°. First end 112 of arm assembly 110 is attached to and outwardly projects from turntable 116. As such, in one embedment, arm assembly 110 can rotate horizontally relative to base 106 about any desired angle.

First end 112 of arm assembly 110 is pivotably mounted to turntable 116 by a hinge 117. Hinge 117 enables arm assembly 110 to pivot vertically up and down relative to turntable 116/base 106 over an angle of at least 45°, 70°, or, most commonly, at least 90°. In the depicted embodiment, arm assembly 110 comprises a main arm 118 and one, two, three or more inner arms 119 that are telescopically nested within main arm 118. As such, main arm comprises a telescoping arm. In one embodiment, basket assembly 104 is hingedly mounted at the end of inner arms 119/second end 114 by a motorized joint 127. Motorized joint 127 enables controlled tilting of basket assembly 104 so that basket assembly 104 can remain horizontally disposed or otherwise angled as arm assembly 110 is pivoted at hinge 117. In alternative embodiments, end of inner arms 119/second end 114 can be securely fixed to basket assembly 104 so that no tilting is permitted between arm assembly 110 and basket assembly 104. In this configuration, as discussed below in more detail, portions of basket assembly 104 can be configured to mechanically tilt as needed.

Inner arms 119 can telescopingly expand out from and retract back into main arm 118 to selectively move basket assembly 104 further away from or closer to base 106. In view of the foregoing, arm assembly 110 is movable relative to base 106 so that basket assembly 104 can be moved in any desired direction and to any desired location relative to base 106. For example, in the depicted embodiment, first end 112 of arm assembly 110/basket assembly 104 can rotate horizontally over any desired angle, pivoted vertically, typically over an angle of at least 90°, and expended away from or contracted toward base 106. Thus, movement can be accomplished in any desired direction to any desired location by combining the different movement capabilities. It is appreciated that arm assembly 110 can also have other configurations. For example, in an alternative embodiment, arm assembly 110 can be provided with at least one, two, three, or more motorized joints along the length of arm assembly 110 for use in adjusting the position and movement of arm assembly 110/basket assembly 104. Such motorized joints are used in the arms of cherry picker lifts.

Figure 9:
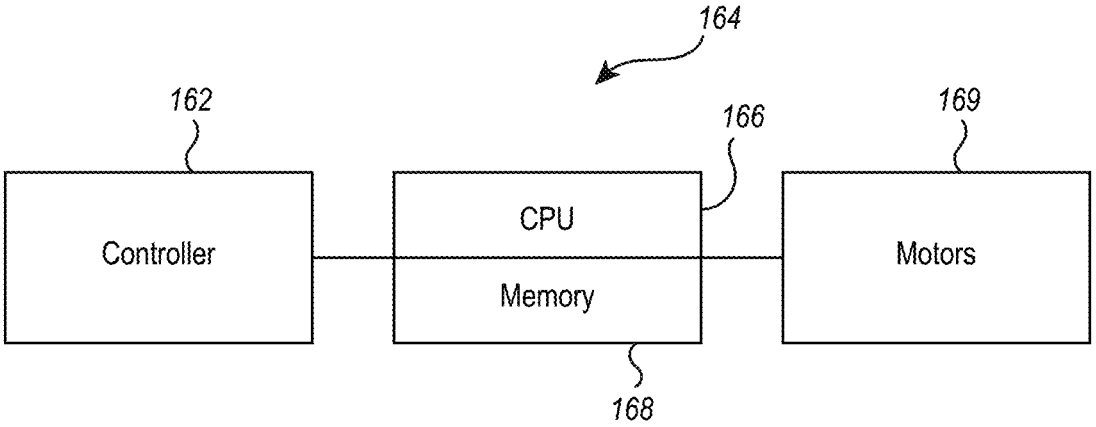
FIG. 9 is a schematic representation of an electronic control system used with the coiled rebar mounting assembly shown in FIG. 6.

As is known in the art, mechanical lift 102 can be provided with one, two, three or more spaced apart motors 169 that control the above discussed movement of arm assembly 110. For example, one or more motors can be used to drive a hydraulic system(s) that facilitates the various movements of arm assembly 110. Such motors can be mounted on or within base 106, turntable 116, and/or arm assembly 110. A controller 162, as shown in FIG. 9, can be electronically coupled with the one or more motors 169 to enable an operator to control movement and operation of arm assembly 110. Controller 162 can be hard wired or wirelessly coupled to the motors 169. In one embodiment, controller 162 can be mounted on basket assembly 104 or at other locations on mechanical lift 102. Controller 162 can also be disposed remotely from mechanical lift 102.

Figure 7:
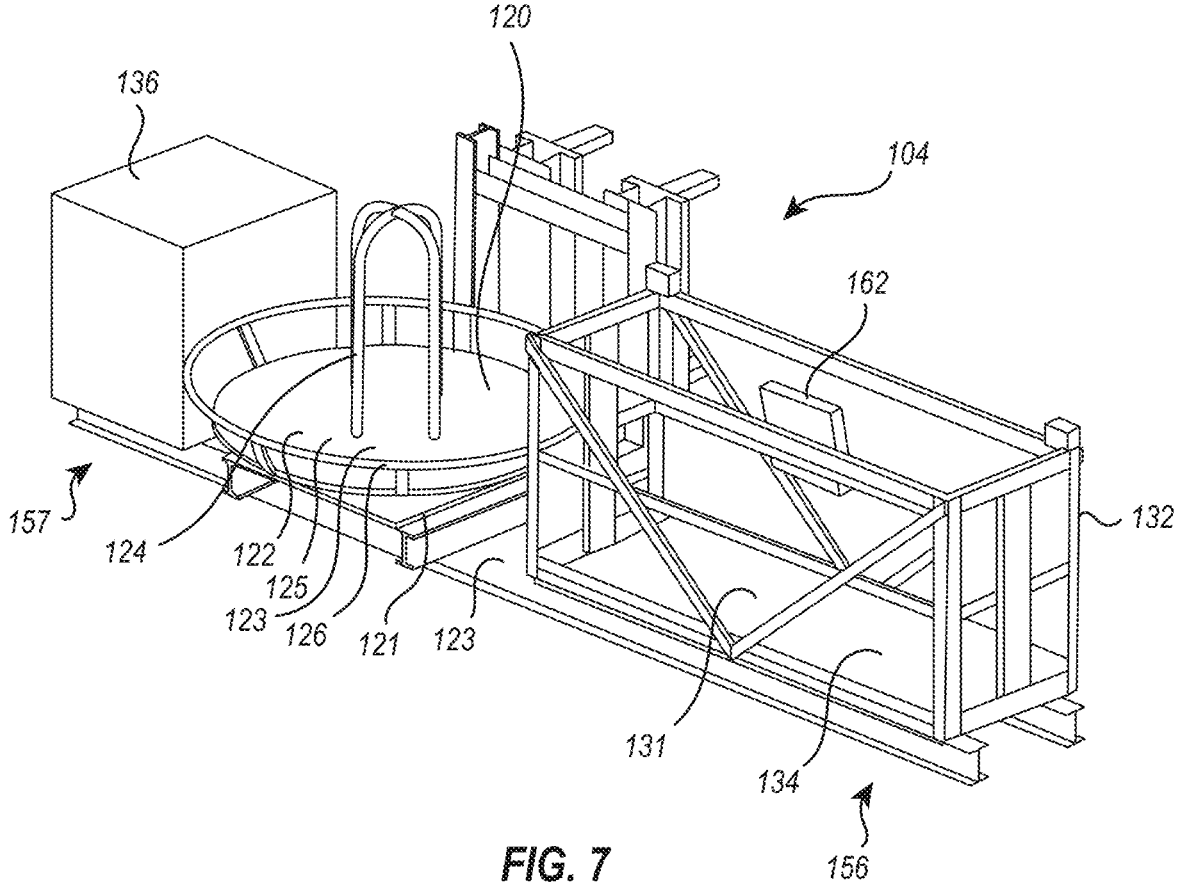
FIG. 7 is a perspective view of the basket assembly of the coiled rebar mounting assembly shown in FIG. 6.

With reference to FIGS. 6 and 7, basket assembly 104 typically includes a platform 123 mounted on second end 114 of arm assembly 110. Mounted on platform 123 is a coiled rebar dispenser 120. In general, coiled rebar dispenser 120 includes a base 121 having a spindle 125 rotatably mounted thereon. Base 121 can comprise either a portion of platform 123 or can be mounted on platform 123. Spindle 125 comprises a stand 122 that is typically circular, although other shapes will also work. An optional centering arm 124 centrally upstands from stand 122 while an optional perimeter rail 126 upstands from an outer perimeter of stand 122. Perimeter rail 126 either fully or at least partially encircles stand 122. A motor can be used to power the rotation of spindle 125 and can be mounted on base 121 and/or platform 123 or be otherwise disposed adjacent to spindle 125. Controller 162 (FIG. 9) can be electrically coupled with the motor for selectively controlling the activation and the operational speed and direction of rotation of spindle 125.

Figure 8:
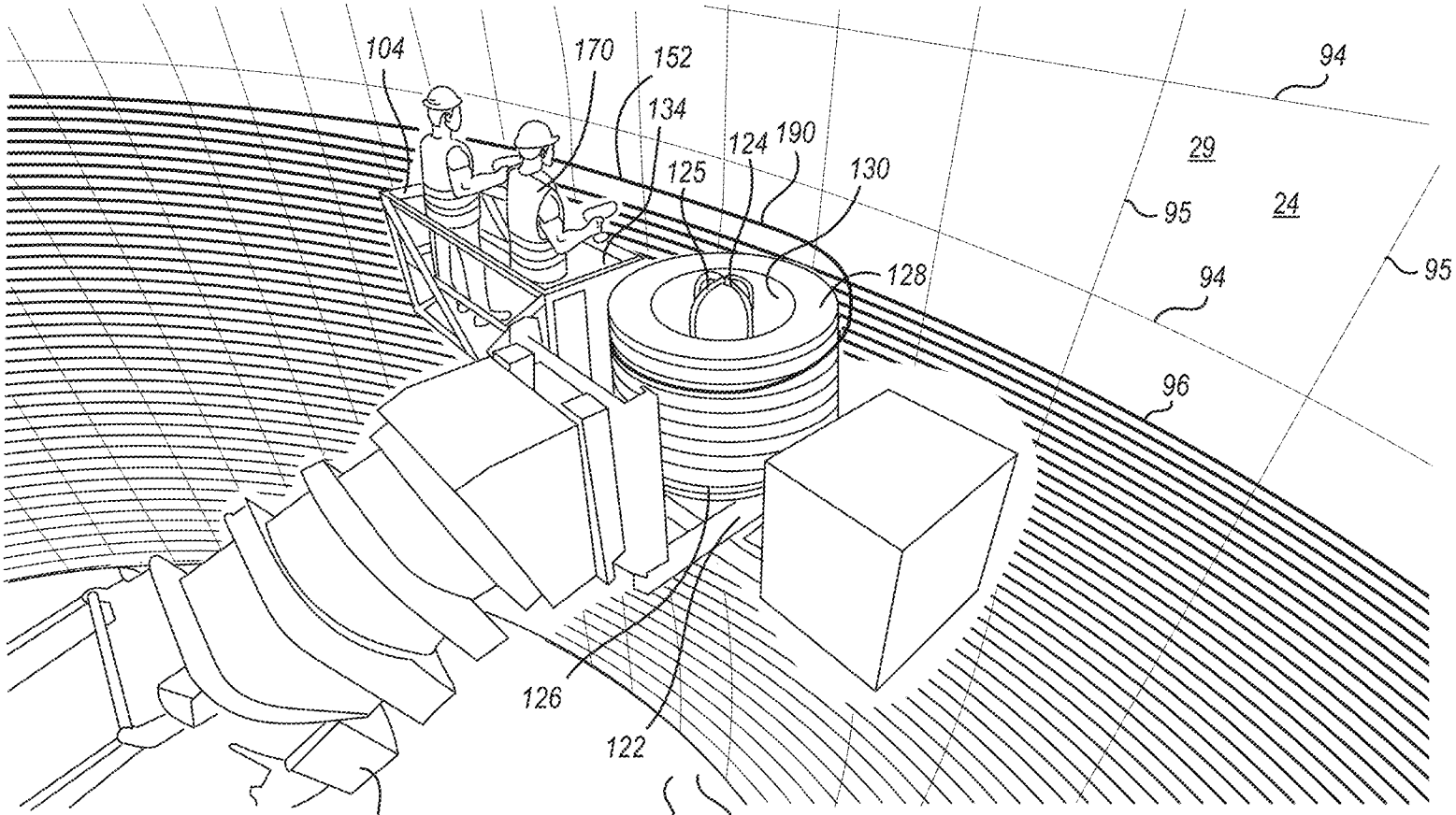
FIG. 8 is a perspective view of the basket assembly shown in FIG. 7 having a rebar coil being uncoiled thereon.

During use, as depicted in FIG. 8, a coil of rebar 128 (hereinafter "rebar coil 128") having a central opening 130 passing therethrough is placed on stand 122 so that centering arm 124 passes through central opening 130 and perimeter rail 126 encircles an outer perimeter of rebar coil 128. In this positioning, rebar coil 128 is securely and properly positioned on spindle 125/stand 122. Rebar coil 128 comprises a single continuous strand of rebar or reinforcing bar, herein referred to as rebar strand 190, that is looped into a coil. Rebar coil 128 can comprise "spooled rebar" or "coiled rebar." "Spooled rebar" and "coiled rebar" are known in the art and are produced by different methods to have different properties. For example, spooled rebar is designed to have reduced tangles and twisting during the de-coiling process relative to coiled rebar. The rebar is commonly made of metal such as steel and more commonly carbon steel. However, in other embodiments, the rebar can also be made of other materials such as stainless steel or a composite material such as glass fiber, carbon fiber, or basalt fiber. Rebar coil 128 can be formed from rebar having a variety of different sizes and different lengths. Set forth below is a table outlining different sizes of rebar that can commonly be used for rebar coil 128 and thus used in in the formation of building 10. Each size has a different diameter and is commonly designated by a number. For example, #4 rebar has a larger nominal diameter than #3 rebar. Rebar used in the formation of rebar coil 128 can commonly have a nominal diameter of at least 9 mm, 11 mm, 13 mm, 15 mm, 17 mm, 19 mm, 21 mm, or be in a range between any two of the foregoing. Expressed in other terms, the rebar can have a maximum diameter that is greater than 1 cm, 1.25 cm, 1.5 cm, 1.75 cm, or 2 cm or be in a range between any two of the foregoing.

| Imperial Bar Size | Weight (lb/ft) | Weight (kg/m) | Nominal Diameter (in) | Nominal Diameter (mm) | Nominal Area (in2) | Nominal Area (mm2) |
|---|---|---|---|---|---|---|
| #3 | 0.376 | 0.561 | 0.375 | 9.525 | 0.110 | 71 |
| #4 | 0.688 | 0.996 | 0.500 | 12.700 | 0.200 | 129 |
| #5 | 1.043 | 1.556 | 0.625 | 15.875 | 0.310 | 200 |
| #6 | 1.502 | 2.240 | 0.750 | 19.050 | 0.440 | 284 |
| #7 | 2.044 | 3.049 | 0.875 | 22.225 | 0.600 | 387 |
| #8 | 2.670 | 3.982 | 1.000 | 25.400 | 0.790 | 509 |
| #9 | 3.400 | 5.071 | 1.128 | 28.650 | 1.000 | 645 |

The length of rebar strand 190 used in the formation of rebar coil 128 typically varies based on the size and quantity of rebar being used. However, the lengths can be standard lengths or customized lengths. In one embodiment, the length of rebar strand 190 used in the formation of rebar coil 128 is at least 250 meters, 500 meters, 1,000 meters, 1,500 meters, 2,000 meters, 2,500 meters, 3,000 meters, or 3,5000 meters or is in a range between any two of the foregoing. Other lengths can also be used. Rebar coil 128 also has an outside diameter that can vary depending upon the size of rebar being used. In one embodiment the maximum outside diameter can be at least 1 meter, 1.3 meters, 1.6 meters, 2 meters or 2.5 meters or be in a range between any two of the foregoing. Other diameters can also be used.

Returning to FIG. 7, basket assembly 104 also includes a deck 131 on which one or more operators can stand during operation. Deck 131 can comprise a portion of platform 123 or can be disposed on platform 123. Upstanding from platform 123 and/or deck 131 so as to at least partially encircle at least a portion of deck 131 is a safety railing 132. Safety railing 132 typically encircles and at least partially bounds an operation area 134 wherein one, two, or more operators can stand during operation of coiled rebar mounting assembly 100. Safety railing 132 helps prevent an operator from falling out of operation area 134. In one embodiment, controller 162 can be mounted on safety railing 132 or can otherwise be disposed within operation area 134 or be disposed within arm reach of operation area 134 so that operators can control the various operations of coiled rebar mounting assembly 100 while disposed within operation area 134.

In one embodiment, coiled rebar dispenser 120 can be centrally aligned with arm assembly 110 while operation area 134 can be disposed at a first end 156 of platform 123 on one side of coiled rebar dispenser 120. In this configuration, to help balance and stabilize basket assembly 104, an optional counterweight 136 can be mounted on a second end 157 of platform 123 on a side of coiled rebar dispenser 120 opposite of operation area 134. However, in other embodiments, arm assembly 110 can be more centrally aligned between coiled rebar dispenser 120 and operation area 134. In this embodiment, counterweight 136 can be reduced or eliminated.

Returning to FIG. 8, in one method of operation, coiled rebar mounting assembly 100/mechanical lift 102 can be positioned on a floor 158 within chamber 159 that is bounded by stabilizing layer 24. In one embodiment, such as where stabilizing layer 24/building 10 has a dome or circular configuration, coiled rebar mounting assembly 100/mechanical lift 102 can be centrally disposed on floor 158 so as to be equally spaced apart from encircling stabilizing layer 24. Centering coiled rebar mounting assembly 100/mechanical lift 102 on floor 158 typically simplifies operation as it minimizes required movement of coiled rebar mounting assembly 100/mechanical lift 102 during use. However, in other embodiments, coiled rebar mounting assembly 100/mechanical lift 102 need not be centrally mounted on floor 158. Rebar coil 128 is disposed on spindle 125/stand 122 of coiled rebar dispenser 120 and one or more operators 170 are positioned within operation area 134 of basket assembly 104. One or more operators 170 can then use controller 162 (FIG. 7) to move basket assembly 104 adjacent to interior surface 29 of stabilizing layer 24 through the movement of arm assembly 110/mechanical lift 102. An operator 170 then takes a free end of rebar strand 190 of rebar coil 128 and horizontally secures the free end to a first reinforcing strand 95, typically at or adjacent to footing 12 (FIG. 5). Again, the securing is typically accomplished by manually or using a rebar tying tool to tie the rebar together using tying wire.

Further portions of rebar strand 190 are then uncoiled from rebar coil 128 using coiled rebar dispenser 120 and are progressively secured to laterally spaced apart rows of first reinforcing strands 95 so that the uncoiled and secured rebar strand 190, which also corresponds to second reinforcing strand 96, is horizontally or generally horizontally disposed. Concurrently with the uncoiling of rebar coil 128, basket assembly 104 can be moved horizontally, e.g., moved horizontally along interior surface 29 of stabilizing layer 24 a distance commensurate with the length of rebar being uncoiled. Basket assembly 104 can be moved horizontally by one or more operators 170 using controller 162 to laterally move arm assembly 110 such as by rotating turntable 116 relative to base 106 (FIG. 6). The one or more operators 170 then horizontally secure the further uncoiled portion of rebar strand 190 to laterally spaced part rows of first reinforcing strands 95 that extend vertically.

In view of the foregoing, the operation can include uncoiling a section 152 of rebar from rebar coil 128 and then securing the uncoiled section 152 of rebar to the stabilizing layer 24, such as through support strands 94 and/or first reinforcing strands 95, while the uncoiled section 152 of rebar remains connected to the remainder of rebar coil 128 disposed on coiled rebar dispenser 120. Accordingly, during use, the uncoiled section 152 of rebar secured to stabilizing layer 24 can be of a linear length of at least 20 meters, 50 meters, 100 meters, 250 meters, 500 meters, 1,000 meters, or 1,500 meters while the linear length of the rebar remaining in the connected rebar coil 128 can be at least 20 meters, 50 meters, 100 meters, 250 meters, 500 meters, 1,000 meters, or 1,500 meters.

In one method of operation, one operator can use controller 162 to horizontally move basket assembly 104 while a second operator uses controller 162 or a separate controller to concurrently uncoil a corresponding section of rebar coil 128. In an alternative embodiment, as depicted in FIG. 9, controller 162 (which can comprise one or more separate controllers) can incorporate or be coupled with a computer 164 having a central processing unit (CPU) 166 and programmable memory 168. Computer 164/controller 162 can be electrically coupled to one or more motors 169 controlling operation of coiled rebar dispenser 120 and mechanical lift 102. Computer 164/controller 162 can be programmed to automatically correlate movement of basket assembly 104 and rotation of rebar coil 128/coiled rebar dispenser 120. For example, computer 164/controller 162 can be programmed so that when basket assembly 104 is moved horizontally a distance by an operator, coiled rebar dispenser 120 automatically uncoils a length of rebar from rebar coil 128 that is commensurate with the lateral distance moved by basket assembly 104. As such, the rebar coil 128 is automatically uncoiled as basket assembly 104 is moved horizontally.

In one method of use of this assembly, the movement of basket assembly 104 and the uncoiling of rebar coil 128 can be done in consecutive or staggered stages. For example, basket assembly 104 can be moved laterally a fixed distance and then stopped. Once the corresponding length of rebar has been secured to first reinforcing strands 95, basket assembly 104 is then moved again another fixed distance and the process is repeated. The lateral movement of basket assembly 104 can be manually controlled by the operator using controller 162. Alternatively, computer 164/controller 162 can be programmed to automatically move a lateral fixed distance, stop for a fixed time interval, and then move again the lateral fixed distance. The movement and stopping is continuously and automatically repeated so that the operator does not have to control movement of the basket assembly 104 or uncoiling rebar coil 128.

In another alternative, computer 164/controller 162 can be programmed to continuously horizontally move basket assembly 104 at an adjustable fixed speed while concurrently uncoiling rebar coil 128 at a corresponding rate. That is, basket assembly 104 can be continuously moved at a sufficiently slow rate that the one or more operators have sufficient time to secure the uncoiling rebar coil 128 to first reinforcing strands 95 without stopping lateral movement of basket assembly 104 until all or a desired amount of rebar coil 128 is mounted or the operator otherwise elects to stop movement of basket assembly 104.

Figure 10:
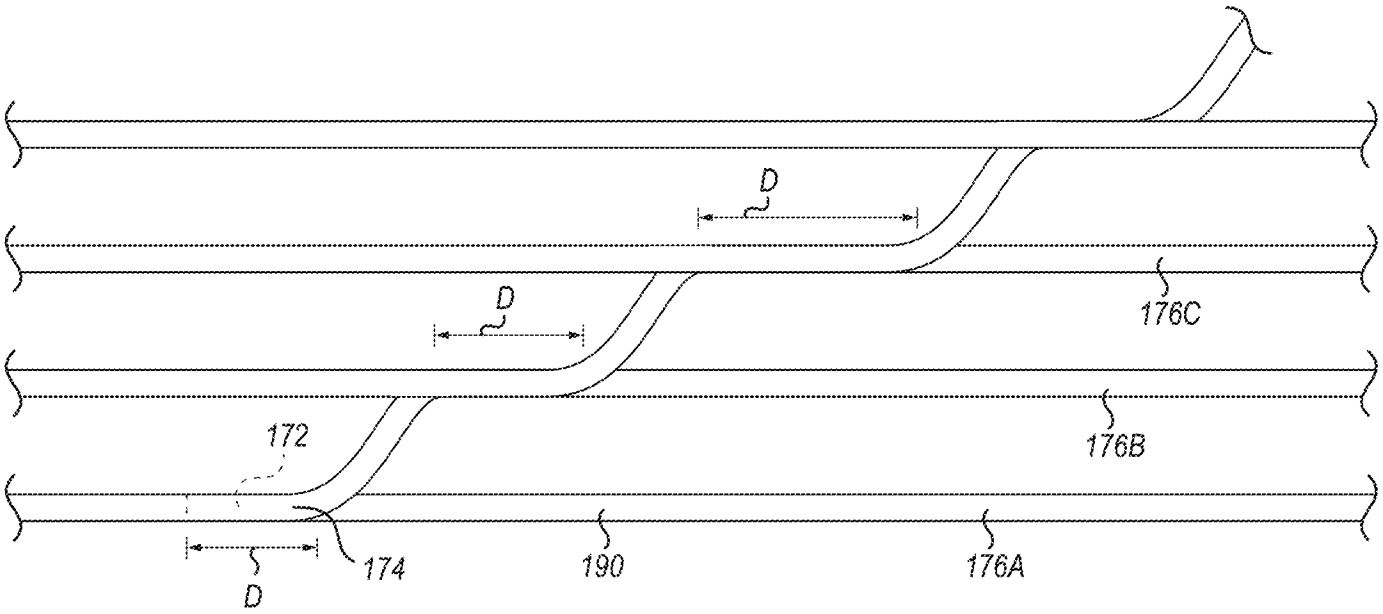
FIG. 10 is an elevated front view of the uncoiled rebar from the rebar coil shown in FIG. 8 mounted on a stabilizing layer.

The above process of uncoiling and securing is repeated until the one or more operators 170 return to and secure rebar strand 190 being uncoiled to the initially secured free end of the rebar, thereby forming a first continuous horizontal loop or row of the rebar. For example, depicted in FIG. 10, a free end 172 of uncoiled rebar strand 190 is overlayed over a distance D by a subsequent uncoiled portion 174 of rebar coil 128 and the overlaid portions are tied together so as to form a first continuous horizontal loop or row 176A. Following uncoiled portion 174, rebar strand 190 is sloped upward to a location for a second continuous horizontal loop or row 176B. This can be accomplished by manually flexing the rebar to slope upward or by bending the rebar, such as by using a rebar bending tool. Once the rebar is moved to the second elevated position, the above process is again repeated where rebar coil 128 is repeatedly uncoiled and secured to the laterally spaced apart first reinforcing strands 95 (FIG. 8) until a second continuous horizontal loop or row 176B is formed.

Again, the starting portion and the ending portion of second continuous horizontal loop 176B are overlayed by a distance D and secured together. Rebar strand 190 is then again sloped upward to a location for a third continuous horizontal loop or row 176B. The process is then continuously repeated until rebar coil 128 is completely uncoiled. A second rebar coil 128 can then be positioned on coiled rebar dispenser 120. The free tail end of the prior rebar coil 128 can then be tied to free front end of the new rebar coil 128 and the above process is continued. As loops/rows 176 are formed at higher elevations, the operators can vertically pivot arm assembly 110 upward and expand arm assembly 110 outward so that basket assembly 104 remains adjacent to stabilizing layer 24 so that the operators can easily reach and mount rebar strand 190 as it is being uncoiled.

Figure 10A:
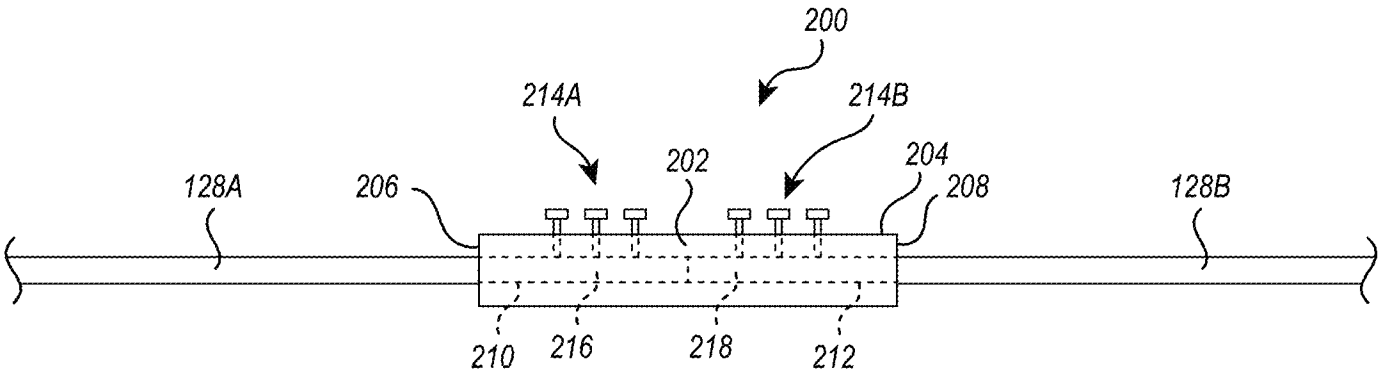
FIG. 10A is an elevated side view of a rebar mechanical coupler coupling the free ends of separate coils of rebar.

In contrast to the free tail end of the prior rebar coil 128 being tied to free front end of the new rebar coil 128 by using conventional rebar tying wire, the opposing ends of the rebar coils can be connected together using a rebar mechanical coupler. For example, depicted in FIG. 10A is one embodiment of a rebar mechanical coupler 200. Mechanical coupler 200 includes a coupler body 202 having an encircling side wall 204 extending between a first end face 206 and an opposing second end face 208. A first channel 210 extends into first end face 206 while a second channel 212 extends into second end face 208. Although not required, in one embodiment, coupler body 202 can be tubular with channels 210 and 212 combining to form a single channel that extends continuously through coupler body 202 between end faces 206 and 208. In other embodiments, channels 210 and 212 can each form a blind hole.

Mechanical coupler 200 also includes a plurality of first bolts 214A that are spaced apart and threaded into encircling side wall 204 and a plurality of second bolts 214B that are spaced apart and threaded into encircling side wall 204. First bolts 214A are aligned with first channel 210 and advance therein as first bolts 214A are threaded into encircling side wall 204. Similarly, second bolts 214B are aligned with second channel 212 and advance therein as second bolts 214B are threaded into encircling side wall 204. During use, a free tail end 216 of a prior rebar coil 128A is received within first channel 210 while a free front end 218 of a new rebar coil 128B is received within second channel 212. First bolts 214A and second bolts 214B are then threaded into encircling side wall 204 so that first bolts 214A are firmly pressed against free tail end 216 of a prior rebar coil 128A and second bolts 214B are firmly pressed against free front end 218 of a new rebar coil 128B, thereby securely fixing together free tail end 216 and free front end 218.

Mechanical coupler 200 provides a substantially stronger connection between prior rebar coil 128A and new rebar coil 128B than the use of tying wire and thus provides increased strength to the finished reinforcing mat 98. In some embodiments, mechanical coupler 200 can result in the uncoiled prior rebar coil 128A and new rebar coil 128B functioning, with regard to strength properties, as a single, continuous strand of rebar. The use of subsequent rebar coils in the formation of reinforcing mat 98 can similarly be connected in series using additional mechanical couplers 200. Although rebar mechanical couplers are more expensive than the use of tying wire, because entire coils of rebar are used in the formation reinforcing mat 98, relatively few rebar mechanical couplers are required. In this case, the increased strength provided by the rebar mechanical couplers can more than compensate for the increased cost.

It is appreciated that rebar mechanical couplers also come in other configurations, known in the art, that can also be used in the present disclosure. For example, in other embodiments, the mechanical coupler can comprise a tubular coupler body that receives the free end of two separate rebar coils and secures them together by crimped engagement, threaded engagement, or a wedged engagement. Other configurations can also be used.

Depending on the size of building, the size of rebar used in rebar coil 128, and the location of where the rebar is being applied, a single coil of rebar coil 128 may continuously extend around the inner circumference of stabilizing layer 24, i.e., encircle compartment 20, at least 0.5, 1, 1.5, 2, 2.5, 3.5, 4, 4.5, 5, or 6 times or in a range between any two of the foregoing. Other values can also be achieved. The above process can be repeated until the desired number of continuous horizontal loops or rows are formed extending from footing 12 to the top end of the building. The vertical spacing between adjacent loops/rows 176 of the uncoiled rebar strand 190, i.e., second reinforcing strands 96, can depend upon factors such as the size of the rebar, the size of the building, and the load the building will carry. However, in some embodiments, the spacing between adjacent loops/ rows can be at least or less than 3 cm, 5 cm, 10 cm, 15 cm, 20 cm, or 30 cm or in a range between any two of the foregoing. Other dimensions can also be used.

Furthermore, the vertical spacing between uncoiled rebar strand 190/second reinforcing strands 96 can vary along the height of building 10. For example, the wall of building 10 is subject to greater loads toward the lower end of the wall. As such, horizontal rebar strand 190/second reinforcing strands 96 may be spaced closer together at the lower end of the wall than at the upper end of the wall. In addition, depending on the size, configuration, and other engineering requirements of building 10, rebar of one or more different sizes can be used at different locations on building 10. For example, since the base of building 10 carries more weight, the uncoiled rebar strands 190/second reinforcing strands 96 can be larger and/or closer together at the base of building 10 than at the top thereof. However, in one method of forming building 10, all of the uncoiled rebar strand 190/second reinforcing strands 96 can be produced from the same size of rebar. The rebar is moved closer together or further apart to adjust for needed strength properties. Using only one size of rebar achieves a number of benefits. For example, using only one size of rebar eliminates or at least limits the need to order, store, and track different sizes of rebar. In addition, larger diameter rebar can be more difficult to uncoil and more difficult for operators to manipulate and tie. Furthermore, larger diameter rebar may require the use of larger coiled rebar dispensers. As such, using one size of rebar, which has a relatively smaller diameter, eliminates the problems associated with larger diameter rebar. Other benefits also exist.

It is appreciated that depending on the configuration of building 10 and/or structural features of building 10, such as doorways, windows, or other openings, the uncoiled rebar strand 190/second reinforcing strands 96 may not always or ever form a continuous loop at different elevations. For example, in some situations it may be necessary to cut the uncoiled rebar strand 190 and then start again mounting at a different location. As such, uncoiled rebar strand 190/second reinforcing strands 96 may form vertically spaced apart rows but the different rows may not all be continuous loops. Furthermore, each row or loop of uncoiled rebar strand 190/second reinforcing strands 96 are generally not disposed perfectly horizontally. That is, the terms "horizontally" and "vertically" when used in association with rebar placement herein refer to being generally or substantially horizontal or vertical, as would be understood by those skilled in the art. For example, rebar disposed horizontal or vertical may have a variance at different locations along the length thereof of +/−20 cm, 15 cm, 10 cm, or 5 cm depending on the specific application.

It is also appreciated that in alternative embodiments, modifications can be made to the configuration and method of forming reinforcing mat 98 (FIG. 5). For example, in one alternative embodiment, support strands 94 can be eliminated. In this case, first reinforcing strands 95 can be vertically secured to stabilizing layer 24 by hangers 66. Uncoiled rebar strand 190/second reinforcing strands 96 can then be secured to first reinforcing strands 95 using the same method as discussed above. In another alternative embodiment, in contrast to forming support strands 94 from precut sections of rebar that are mounted and tied together, supports strands 94 can be formed using the same process as discussed above with regard to the mounting and placement of uncoiled rebar strand 190/second reinforcing strands 96. That is, coiled rebar mounting assembly 100 can be used with rebar coil 128 (having rebar of desired size) to form reinforcing strands 96 as continuous loops or at least elongated lengths of rebar strand 190 that art secured to stabilizing layer 24 by hangers 66. In another alternative embodiment, in contrast to mounting uncoiled rebar strand 190/second reinforcing strands 96 as vertically spaced apart loops or rows that are generally horizontally disposed, the uncoiled rebar strand 190/second reinforcing strands 96 can be secured to stabilizing layer 24 in a continuous or extended length helical configuration that upwardly extends along stabilizing layer 24.

Figure 11:
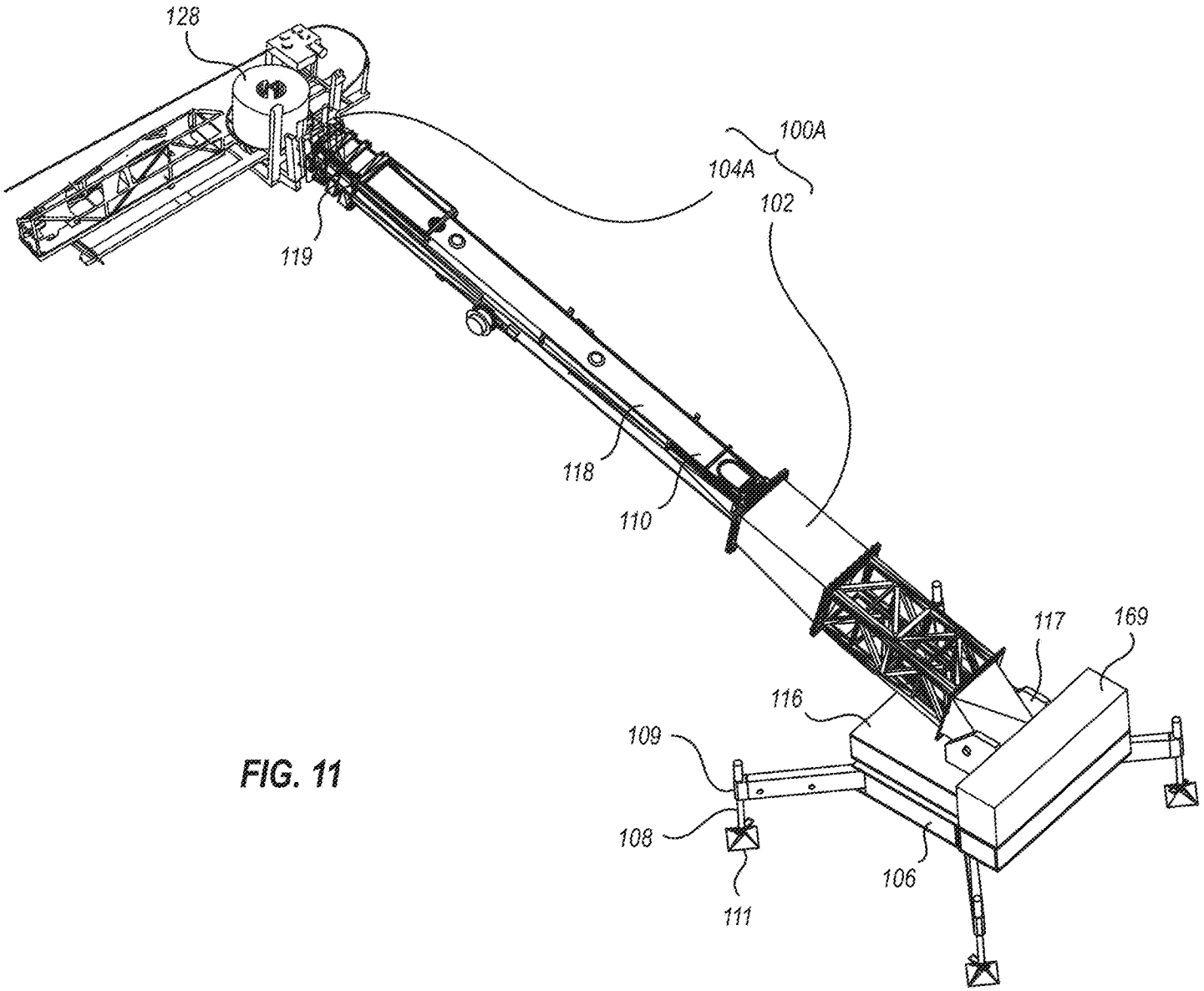
FIG. 11 is a perspective view of an alternative embodiment of the coiled rebar mounting assembly shown in FIG. 6.

It is also appreciated that basket assembly 104 used in the uncoiling and mounting of rebar coil 128 can have a variety of different configurations. For example, depicted in FIG. 11 is an alternative embodiment of a coiled rebar mounting assembly 100A incorporating features of the present disclosure. Coiled rebar mounting assembly 100A includes mechanical lift 102, as previously discussed, having a basket assembly 104A mounted thereon. All of the prior discussion, elements, functions, and alternatives previously discussed with regard to mechanical lift 102 discussed in regard to coiled rebar mounting assembly 100 are also applicable to coiled rebar mounting assembly 100A. Furthermore, like elements between basket assembly 104 and 104A are identified by like reference numbers.

Figure 12:
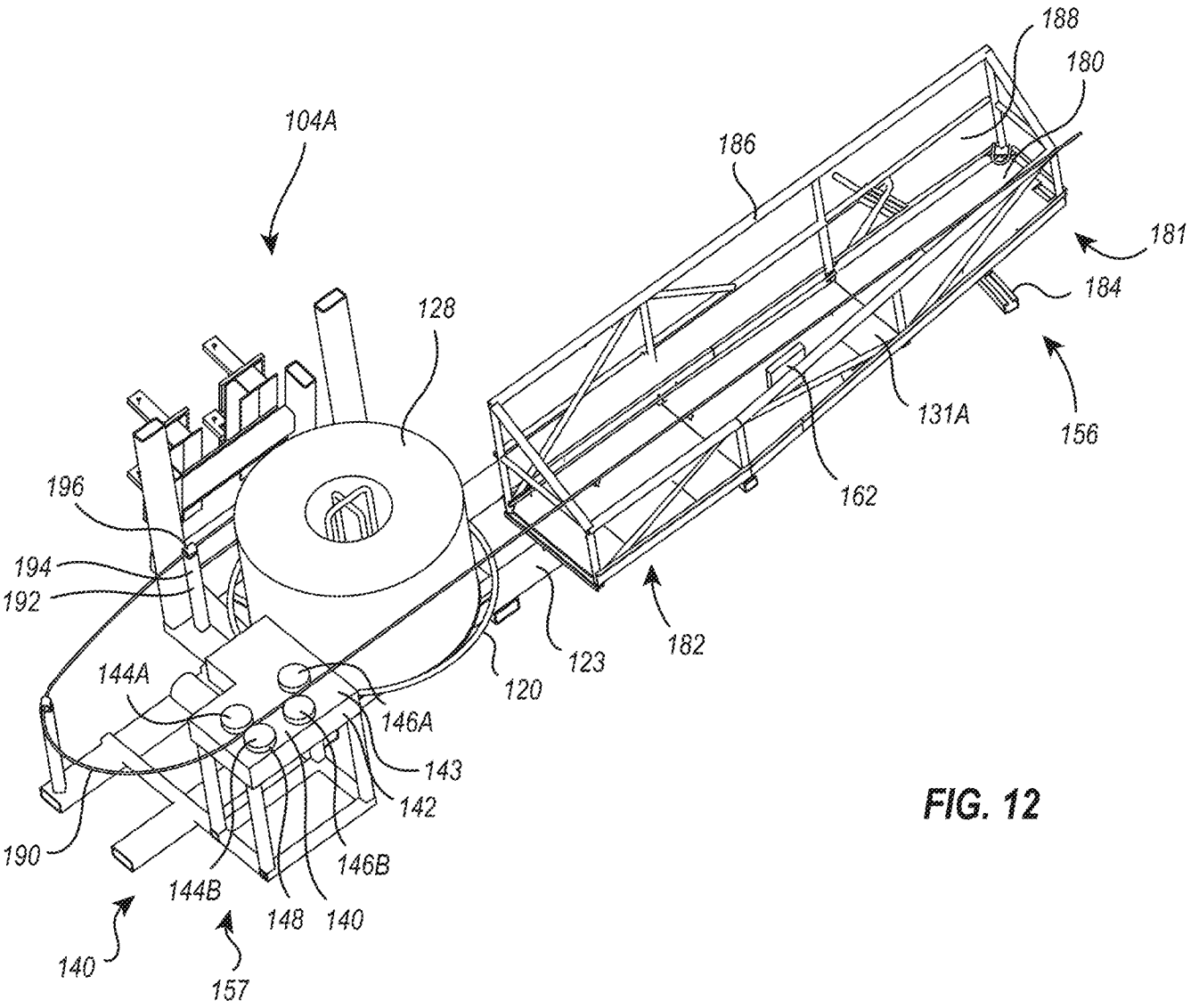
FIG. 12 is a perspective view of the basket assembly of the coiled rebar mounting assembly shown in FIG. 11.

Turning to FIG. 12, basket assembly 104A comprises platform 123 extending between first end 156 and second end 157. Disposed on platform 123 in alignment with arm assembly 110 is coiled rebar dispenser 120 having rebar coil 128 disposed thereon. Basket assembly 104A also includes a deck 180 on which one or more operators can stand during operation. Upstanding from deck 180 so as to at least partially encircle at least a portion of deck 180 is a safety railing 186. Safety railing 186 typically encircles and at least partially bounds an operation area 188 wherein which one, two, or more operators can stand during operation of coiled rebar mounting assembly 100A. Safety railing 186 helps prevent an operator from falling out of operation area 188.

Deck 180 has a first end 181 and an opposing second end 182. Deck 180 is disposed on platform 123 with second end 182 being pivotably coupled to platform 123 so that deck 180 can horizontally pivot on top of platform 123. An arced track 184 is disposed at first end 156 of platform 123. First end 181 of deck 180 movably engages with and is supported by track 184. As a result, first end 181 of deck 180 with safety railing 186 can pivot laterally forward or rearward relative to platform 123. Because building 10 is commonly in the form of a dome having a curved outer wall, the ability to enable deck 180 with safety railing 186 to pivot forward or backwards enables the operators to precisely position deck 180 with safety railing 186 at a desired position from stabilizing layer 24 (FIG. 8) to optimize positioning and attachment of the rebar. Deck 180 can be configured to be manually pivoted and locked in place or a motor can be used to selectively pivot deck 180. The motor operating deck 180 can be controlled by controller 162. In one embodiment, controller 162 can be mounted on safety railing 186 or can otherwise be disposed within operation area 188 or be disposed within arm reach of operation area 188 so that operators can control the various operations of coiled rebar mounting assembly 100A while disposed within operation area 188. In other embodiments, two or more controllers can be mounted on different locations for controlling the different motors of coiled rebar mounting assembly 100A.

Basket assembly 104A can also include a rebar straightener 140 mounted on platform 123 at second end 157. As will be discussed below in greater detail, as rebar strand 190 is uncoiled from rebar coil 128 by coiled rebar dispenser 120, rebar strand 190 will have a resting curvature that is typically significantly smaller than the curvature of interior surface 29 of stabilizing layer 24. In this case, the resilient spring force of rebar strand 190 can make it difficult or even impossible for an operator to manually position and secure rebar strand 190 to first reinforcing strands 95, i.e., adjacent to interior surface 29 of stabilizing layer 24 (FIG. 5). Rebar straightener 140 can be used to help straighten rebar strand 190 as it is uncoiled so that rebar strand 190 has a resting curvature that is the same as or sufficient close to the curvature of interior surface 29 of stabilizing layer 24 to enable the one or more operators to manually position and secure rebar strand 190 to first reinforcing strands 95, as previously discussed.

Rebar straightener 140 can have a variety of different configurations. In the depicted embodiment, rebar straightener 140 includes a support 142 having a top face 143. A plurality of rotatably wheels are disposed on support 142 and specifically are disposed on top face 143. The plurality of rotatable wheels typically includes at least a first pair of wheels 144A and 144B that are adjacently disposed in horizontal alignment and a second pair of wheels 146A and 146B that are also adjacently disposed in horizontal alignment but that are spaced apart from first pair of wheels 144A and B. Each of wheels 144 and 146 has an annular perimeter groove 148 configured to receive rebar strand 190. One or more motors facilitate rotation and/or movement of wheels 144 and 146. Controller 162 can be electrically coupled to the one or more motors of rebar straightener 140 and can be used to control operation of rebar straightener 140. During operation, rebar strand 190, as it is uncoiled from rebar coil 128, is passed between the first pair of wheels 144A and B and then between the spaced apart second pair of wheels 146A and B which selectively straighteners, to a desired extent, rebar strand 190. That is, as is known in the art of conventional rebar straighteners, by selectively controlling the spacing between the two pairs of wheels 144 and 146 and/or the alignment between each pair of wheels 144 and 146, rebar strand 190 can be straightened to be either linear or have a desired resting curvature.

Basket assembly 104A also includes one, two, three or more guideposts 192 upstanding from platform 123. Each guidepost 192 comprises a post body 194 upstanding from platform 123 and a guide opening 196 passing through the upper end thereof. Guide openings 196 are sized so that rebar strand 190 can pass therethrough. Guideposts 192 are positioned to help guide and control rebar strand 190 as it uncoils from rebar coil 128 and extends to rebar straighter 140. Any desired number of guideposts 192 can be used that are necessary or helpful in guiding and controlling rebar strand 190 as it passes from rebar coil 128 to rebar straighter 140. Rebar straightener 140 is orientated so that rebar strand 190 exiting rebar straightener 140 is directed toward a front side of safety railing 186 for mounting by the operators disposed within operation area 188, as previously discussed with regard to basket assembly 104.

In the same manner as previously discussed with regard to basket assembly 104, controller 162/computer 164 (FIG. 9) can be electrically coupled with the various motors of coiled rebar dispenser 120 and mechanical lift 102 to synchronize uncoiling of rebar coil 128 with movement of basket assembly 104A. However, in this embodiment, controller 162/computer 164 can also be electrically coupled with the one or more motors of rebar straightener 140 to also concurrently synchronize the operation of rebar straightener 140. That is, controller 162/computer 164 (FIG. 9) can be programed to correlate the straightening of rebar strand 190, i.e., the movement of rebar strand 190 through rebar straightener 140, with the uncoiling of rebar coil 128 and the movement of basket assembly 104A. Expressed in other terms, controller 162/computer 164 can be programmed to automatically correlate movement of mechanical lift 102 and coiled rebar dispenser 120 with operation of rebar straightener 140.

In view of the foregoing, by using coiled rebar mounting assembly 100 or 100A or any combination or modification thereof, reinforcing mat 98 can be formed on or adjacent to interior surface 29 of stabilizing layer 24.

Figure 13:
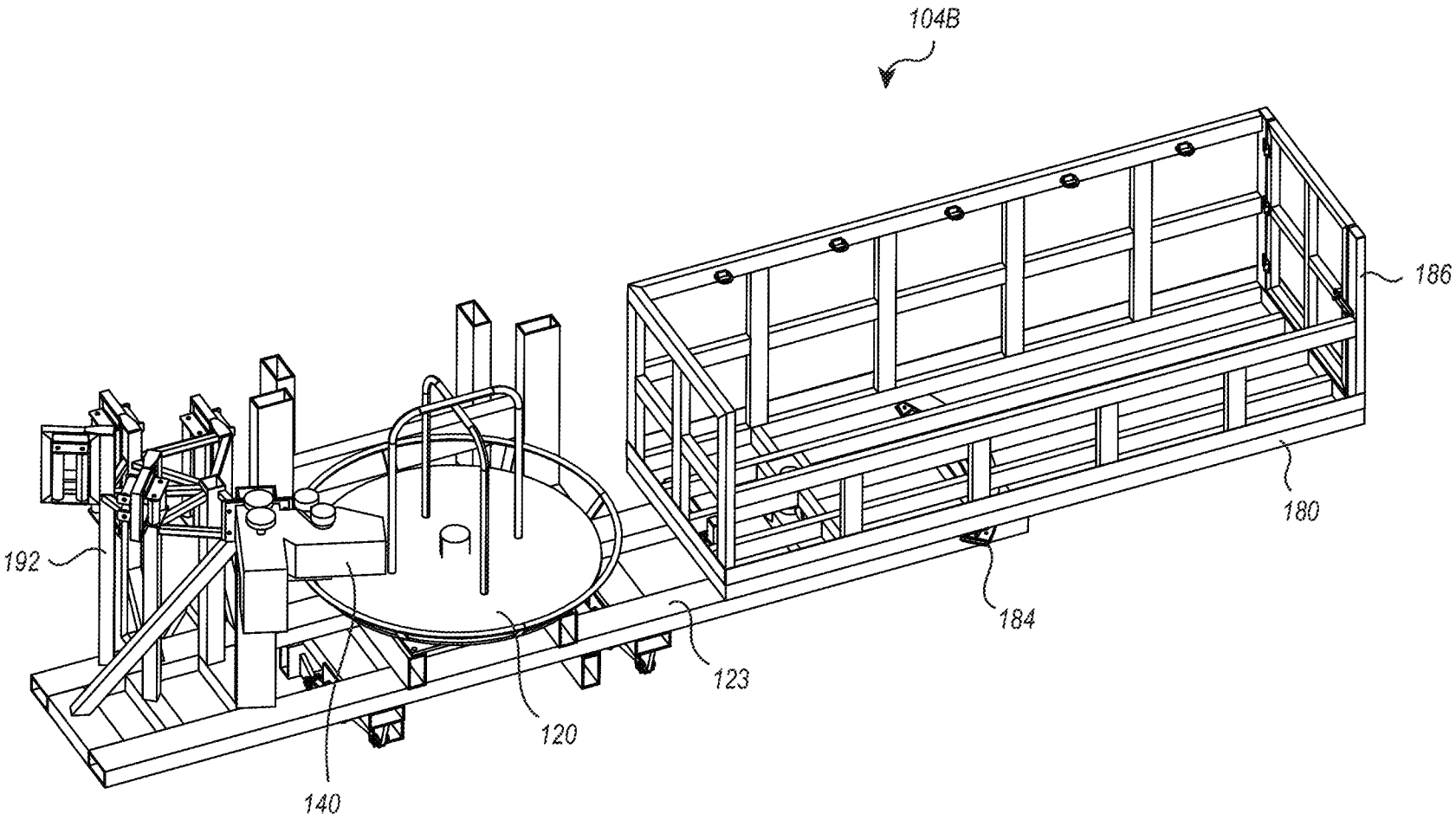
FIG. 13 is a top perspective view of another alternative embodiment of a basket assembly.
Figure 14:
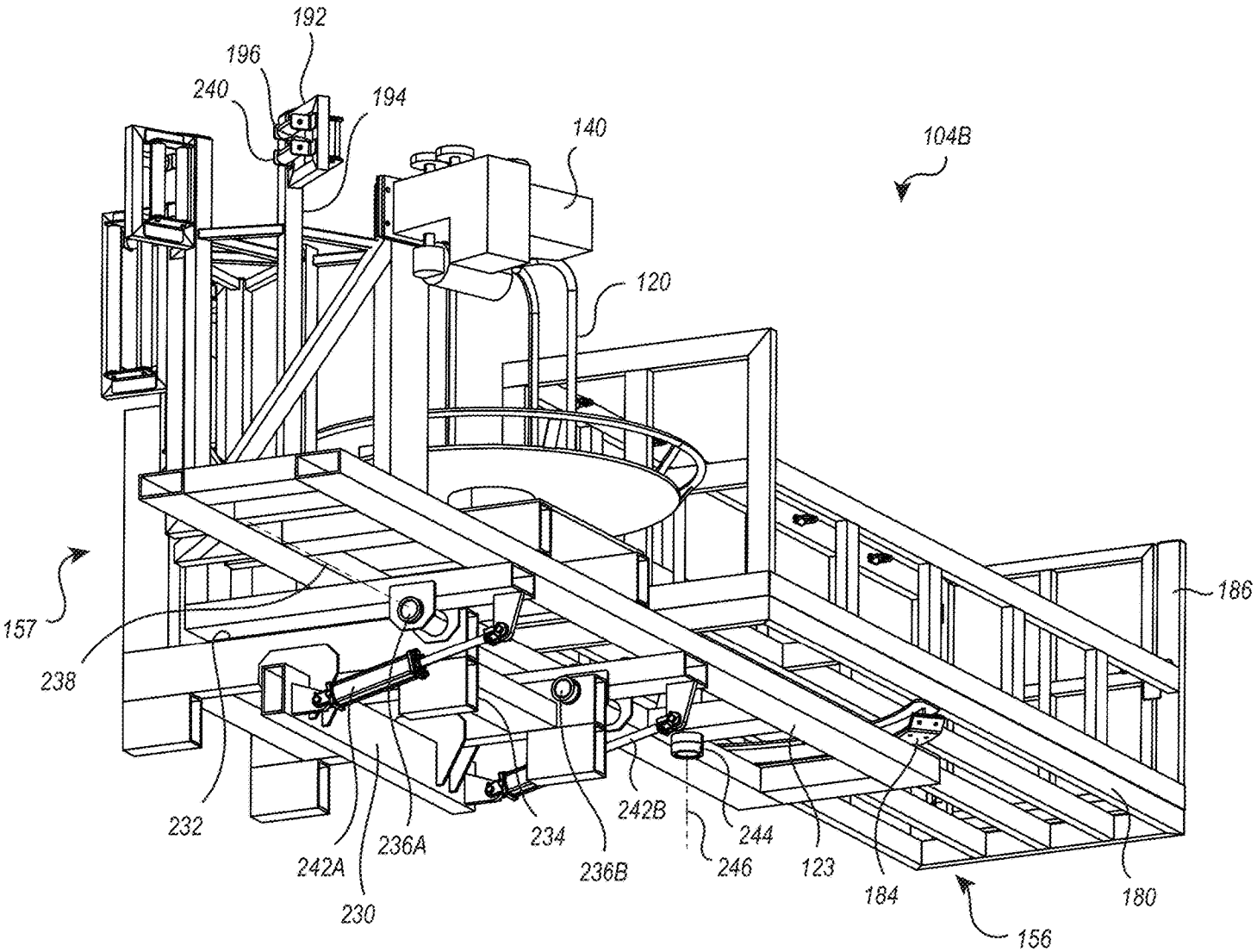
FIG. 14 is a bottom perspective view of the basket assembly shown in FIG. 13.
Figure 15:
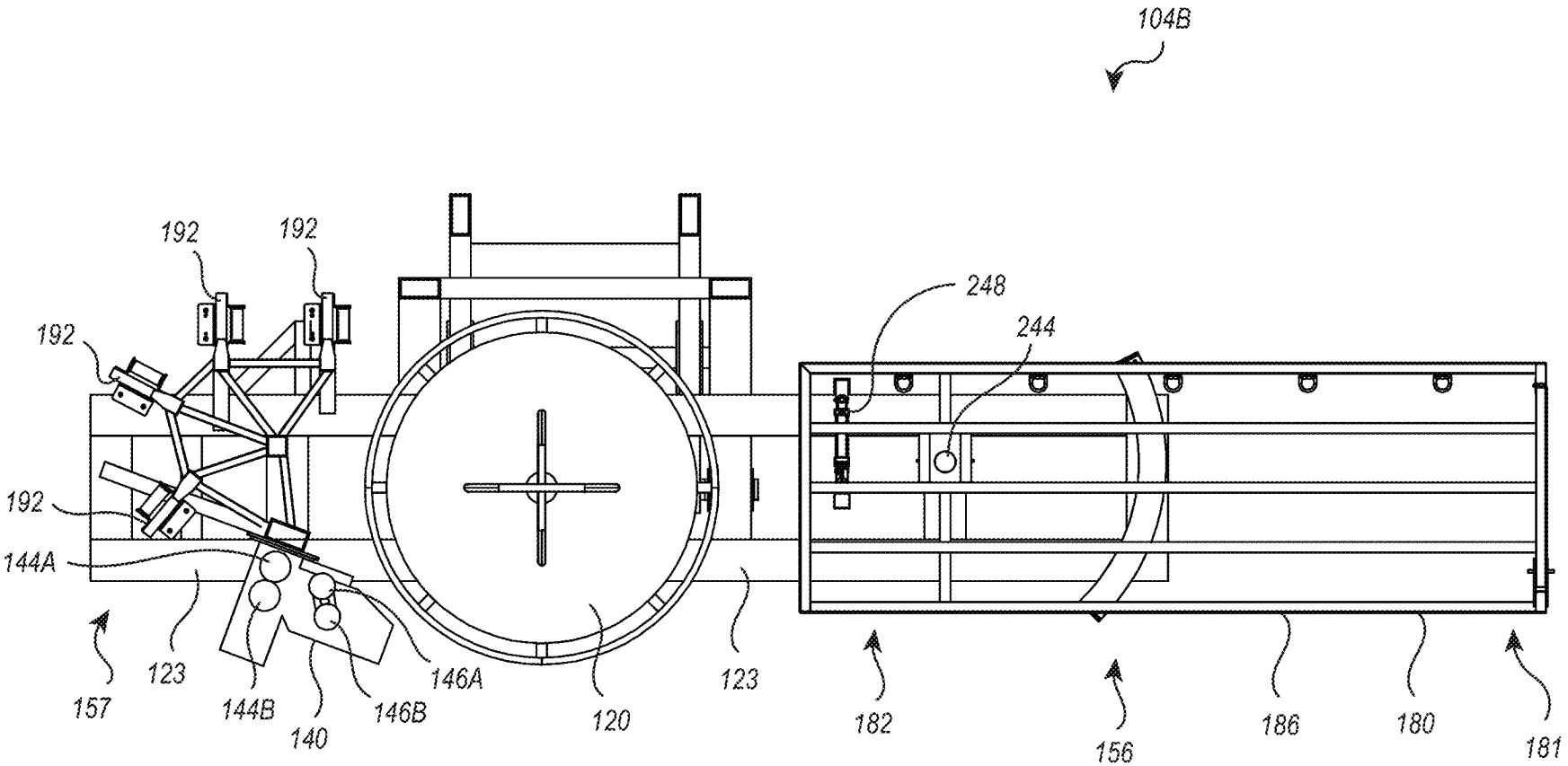
FIG. 15 is a top plan view of the basket assembly shown in FIG. 13.

Depicted in FIGS. 13-15 is another alternative embodiment of a basket assembly 104B that can be used with the mechanical lifts disclosed herein. Except as noted below, all of the prior discussion, elements, functions, and alternatives previously discussed with regard to basket assemblies 104 and 104A are also applicable to basket assembly 104B. Furthermore, like elements between basket assembles 104, 104A and 104B are identified by like reference numbers.

Basket assembly 104B includes a base support 230 which can be permanently fixed to or removably mounted on second end 114 of arm assembly 110 (FIG. 11). In this embodiment, arm assembly 110 can be formed without joint 127 (FIG. 6), i.e., base support 230 can be secured to second end 114 of arm assembly 110 so that no pivoting or other movement is provided therebetween. However, platform 123 is hingedly mounted on base support 230. Specifically, in one embodiment, base support 230 has a top face 232 that extends to an outside face 234. Platform 123 is disposed on top face 232 so as to overhang outside face 234. Hinges 236A and 236B hingedly couple platform 123 to base support 230 adjacent to outside face 234. As such, platform 123 can pivot relative to base support 230 by hinges 236. More specifically, platform 123 can pivot relative to base support 230 about a first axis of rotation 238 formed by hinges 236. Basket assembly 104B also includes means for selectively pivoting platform 123 about first axis of rotation 238. In the depicted embodiment, the means for selectively pivoting comprises a pair of hydraulic cylinders 242A and 242B extending between base support 230 and the overhanging end of platform 123. Operating hydraulic cylinders 242A and 242B enables platform 123 to be tilted relative to base support 230 over an angle of at least 45°, 70°, 85°, 90°, or 120° or in a range between any two of the foregoing. In one embodiment, the angle can be in a range between 0° and 90°. Other angles can also be produced. In contrast to using hydraulic cylinders 242 to pivot platform 123, it is appreciated that other drive system can be used. For example, the hydraulic cylinders 242 can be replaced with a pully system, levers, rack and pinion, lifts, pneumatic cylinders, spool and cable systems, or other drive systems commonly known in the art.

Deck 180 with safety railing 186 are disposed on first end 156 of platform 123 while rebar straightener 140 and spaced apart guideposts 192 are disposed at second end 157 of platform 123. Coiled rebar dispenser 120 is disposed on platform 123 between first end 156 and second end 157 and is configured to receive rebar coil 128 and dispense rebar strand 190 (FIG. 12), as previously discussed. As also previously discussed, each guidepost 192 includes an elongated, upstanding post body 194 and a guide opening 196 extending through an upper free end thereof. Guide openings 196 receive and guide rebar strand 190 as it passes from rebar coil 128 to rebar straightener 140. In the depicted embodiment, guide openings 196 are at least partially bounded by rollers 240 which help rebar strand 190 to smoothly travel through the guide openings 196.

As previously discussed with regard to basket assembly 104A, during use one or more operators stand on deck 180 and secure rebar strand 190 passing out of rebar straightener 140 to stabilizing layer 24/first reinforcing strands 95 (FIG. 8). However, because in many embodiments stabilizing layer 24 is at least partially dome shaped, e.g., curves inwardly as it extends upward, as basket assembly 104B is raised higher by arm assembly 110/mechanical lift 102 while remaining adjacent to stabilizing layer 24, platform 123 and deck 180 become increasingly tilted relative to horizontal, thereby making it dangerous for the operators standing on deck 180. By using hydraulic cylinders 242 or other drive systems, platform 123, and thus also deck 180 disposed thereon, can be tilted so as to remain substantially horizontal as arm assembly 110/mechanical lift 102 selectively raises and lowers basket assembly 104B, thereby maintaining a safe environment for the operators standing on deck 180. The hydraulic cylinders 242 can be controlled by controller 162 (FIG. 7) that can be mounted on or adjacent to safety railing 186. In one embodiment, controller 162 can be programmed to automatically pivot platform 123 so that platform 123/deck 180 is maintained in a substantially horizontal position as arm assembly 110 is raised and lowered.

As with basket assembly 104A, deck 180 of basket assembly 104B is pivotably mounted to platform 123. Specifically, second end 182 of deck 180 is rotatably coupled to platform 123, such as by a swivel 244 having a second axis of rotation 246. As second end 182 of deck 180 pivots about second axis of rotation 246, first end 181 travels is an arc along curved track 184. This selective pivoting or rotating of deck 180 allows the operators to adjust the position of deck 180 relative to stabilizing layer 24 so that deck 180 is optimally position for operators on deck 180 to secure rebar strand 190 to stabilizing layer 24/first reinforcing strands 95. As previously discussed, rebar strand 190 is typically secured so as to be horizontally or substantially horizontally disposed.

In one embodiment, a driver 248 is provided for pivoting deck 180 about second axis of rotation 246. In the depicted embodiment, driver 248 comprises a hydraulic cylinder extending between platform 123 and deck 180. In alternative embodiments, the hydraulic cylinder can be replaced with a variety of other driver systems such as a pully system, lever, rack and pinion, lift, pneumatic cylinder, spool and cable system, or other drive systems commonly known in the art. It is noted that the second axis of rotation 246 is typically disposed orthogonal to the first axis of rotation 238 but can be disposed at other angles.

Figure 16:
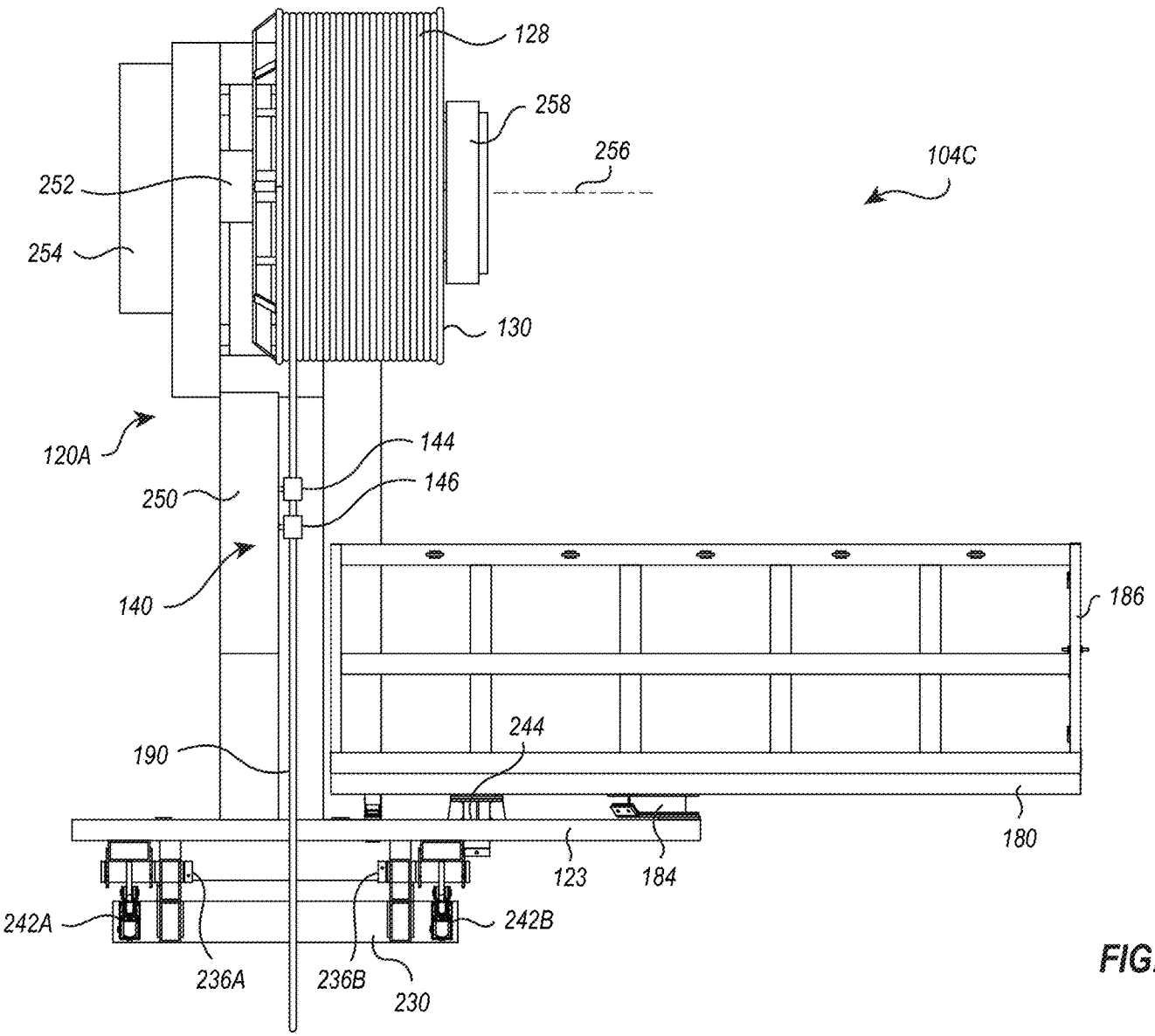
FIG. 16 is a front elevational view of another alternative embodiment of a basket assembly used to vertically dispense rebar.

Depicted in FIG. 16 is still another alternative embodiment of a basket assembly 104C that can be used with the mechanical lifts disclosed herein. Except as noted below, all of the prior discussion, elements, functions, and alternatives previously discussed with regard to basket assemblies 104, 104A, and 104B are also applicable to basket assembly 104C. Furthermore, like elements between basket assembles 104, 104A, 104B and 104C are identified by like reference numbers.

Basket assembly 104C includes base support 230 that can be permanently fixed to or removably mounted on second end 114 of arm assembly 110 (FIG. 11). Platform 123 is hingedly mounted on base support 230 using hinges 236A and 236B and hydraulic cylinders 242A and 242B, as previously discussed. Likewise, deck 180 is rotatably mounted on platform 123 using swivel 244. However, in contrast to basket assembly 104B where rebar coil 128 is horizontally disposed on coiled rebar dispenser 120 so as to horizontally dispense rebar strand 190, in basket assembly 104C, rebar coil 128 is vertically disposed so that rebar strand 190 is vertically dispensed. Specifically, a coiled rebar dispenser 120A is provided that includes a stand 250 upstanding from platform 123 adjacent to deck 180. A rotor 252 projects from an upper end of stand 250 and is rotated by a motor 254. Rotor 252 rotates about an axis of rotation 256 that is horizontally disposed. Rebar coil 128 is removably secured on rotor 252, i.e., rotor 252 extends into central opening 130 (FIG. 8) of rebar coil 128, so that rotation of rotor 252 facilitates rotation of rebar coil 128 about axis of rotation 256. A retainer 258 can be removably secured to a free end of rotor 252 on an opposing side of rebar coil 128 for securing and retaining rebar coil 128 on rotor 252.

As rebar coil 128 is rotated by rotor 252, rebar strand 190 is dispensed downward from rebar coil 128 and passes between wheels 144 and 146 of rebar straightener 140 for desired straightening of rebar strand 190. In this embodiment, rebar strand 190 can extend vertically as it extends from rebar coil 128 and/or after is passes through rebar straightener 140. In this regard, rebar straightener 140 can be mounted vertically as opposed to horizontally as shown in FIG. 13.

Basket assembly 104C can be used for dispensing rebar that is used as previously discussed first reinforcing strands 95. That is, as shown in FIGS. 5 and 8, after support strands 95 are secured to stabilizing layer 24, as previously discussed, mechanical lift 102 having basket assembly 104C mounted on arm assembly 110 can be used to raise basket assembly 104C while the rebar strand 190 is vertically dispensed. Again, controller 162 (FIG. 12) can be used to selectively control mechanical lift 102, coiled rebar dispenser 120A, and rebar straightener 140 or can be programed so that coiled rebar dispenser 120A and rebar straightener 140 automatically operate as basket assembly 104C is moved by mechanical lift 102. Operators standing on deck 180 can tie vertically extending rebar strand 190 to horizontal support stands 95 so that rebar strand 190 becomes first reinforcing strands 95. This process eliminates the need to use precut strands of first reinforcing strands 95 which have associated problems. Rather, any desired length of rebar strand 190 can be dispensed and tied for the desired length of a first reinforcing strand 95. The rebar strand 190 can then be cut at a desired length and basket assembly 104A moved horizontally to dispense and secure a further rebar strand 190 forming a further first reinforcing strand 95. Once all of the first reinforcing strands 95 are dispensed and secured, basket assembly 104C can be replaced with one of basket assemblies 104, 104A or 104B to horizontally dispense and secure rebar strand 190 as second reinforcing strands 96, as previously discussed. Other basket assembly configurations can also be used.

VII. Support Layer

Figure 17:
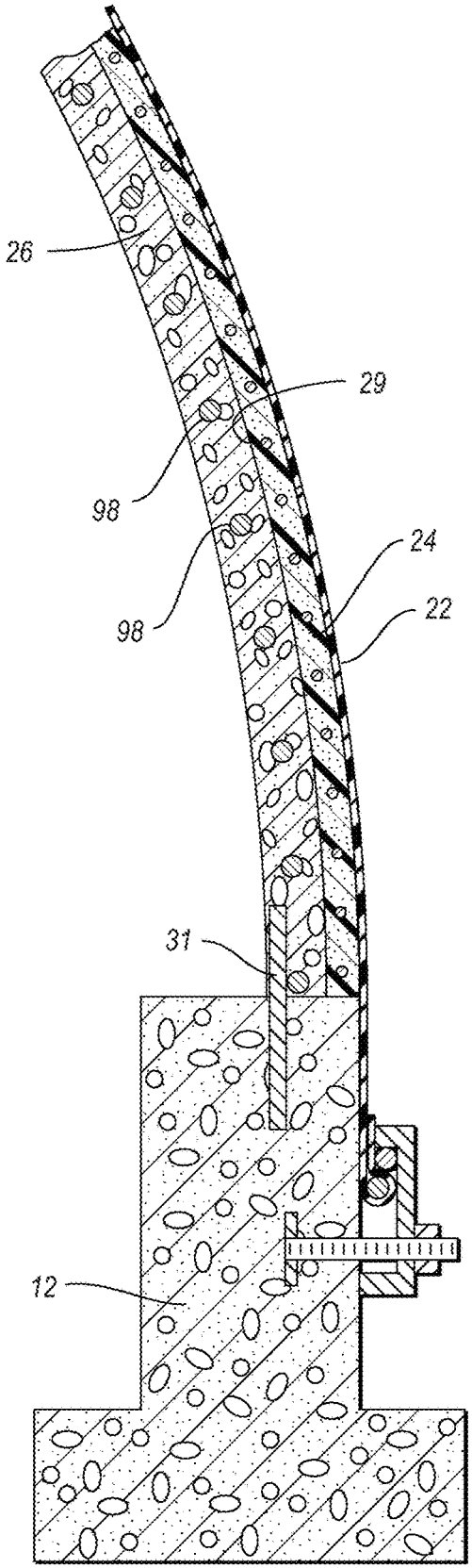
FIG. 17 is the cross sectional view shown in FIG. 2 having a first rebar mat and a first support layer disposed thereon.

As depicted in FIG. 17, once reinforcing mat 98 has been secured adjacent to stabilizing layer 24, a support layer 26 is formed so as to cover interior surface 29 of stabilizing layer 24 and reinforcing mat 98. In this regard, reinforcing mat 98 functions as reinforcing for support layer 26. By covering reinforcing mat 98 with support layer 26, support layer 26 can cover and building 10 include rebar strand 190 having a continuous length of at least 50 meters, 100 meters, 250 meters, 500 meters, 1,000 meters, 1,500 meters, 2,000 meters, 2,500 meters or 3,000 meters. As support layer 26 is built-up adjacent footing 12, support layer 26 can also cover reinforcing rods 31 upwardly projecting from footing 12, thereby fixing support layer 26 to footing 12.

Support layer 26 is typically comprised of a cementitious material. As used in the specification and appended claims, the term "cementitious material" is intended to include any material that includes cement. Cementitious materials typically include graded sand and/or any number of conventional additives such as fillers, fibers, hardeners, chemical additives, or others with function to improve properties relating to strength, finishing, spraying, curing, and the like. In one embodiment, the cementitious material comprises a sprayable concrete such as "gunite" or "shotcrete". Stabilizing layer 24 can also be made of non-cementitious materials as long as they provide the required strength properties.

For efficiency, it is desirable that the material for support layer 26 be sprayable. For example, the cementitious material can be applied through a hose at high velocity which results in dense material having a cured compressive strength in a range between about 3,000 psi to about 10,000 psi. Alternatively, although less efficient, support layer 26 can be applied by hand, such as by use of a trowel, or other techniques.

Support layer 26 may be formed as a single application layer or as multiple overlapping sub-layers. For example, in one embodiment a first support sub-layer is formed over stabilizing layer 24 prior to the attachment of reinforcing mat 98. Once first support sub-layer is formed, reinforcing mat 98 is formed thereon. A second support sub-layer is then applied over the first support sub-layer so as to embed reinforcing mat 98 therebetween. In other alternatives, multiple sub-layers can be applied directly over reinforcing mat 98.

The various sub-layers of support layer 26 can be comprised of the same or different materials. Likewise, cementitious materials of different grade or properties can be used. Although not required, each successive sub-layer of support layer 26 is typically applied before the previous sub-layer is allowed to cure completely so as to effect maximum bonding between the successive sub-layers. The thickness of support layer 26 is in part dependent upon the size and configuration of building 10 and whether other layers or support structures are to be added.

Figure 18:
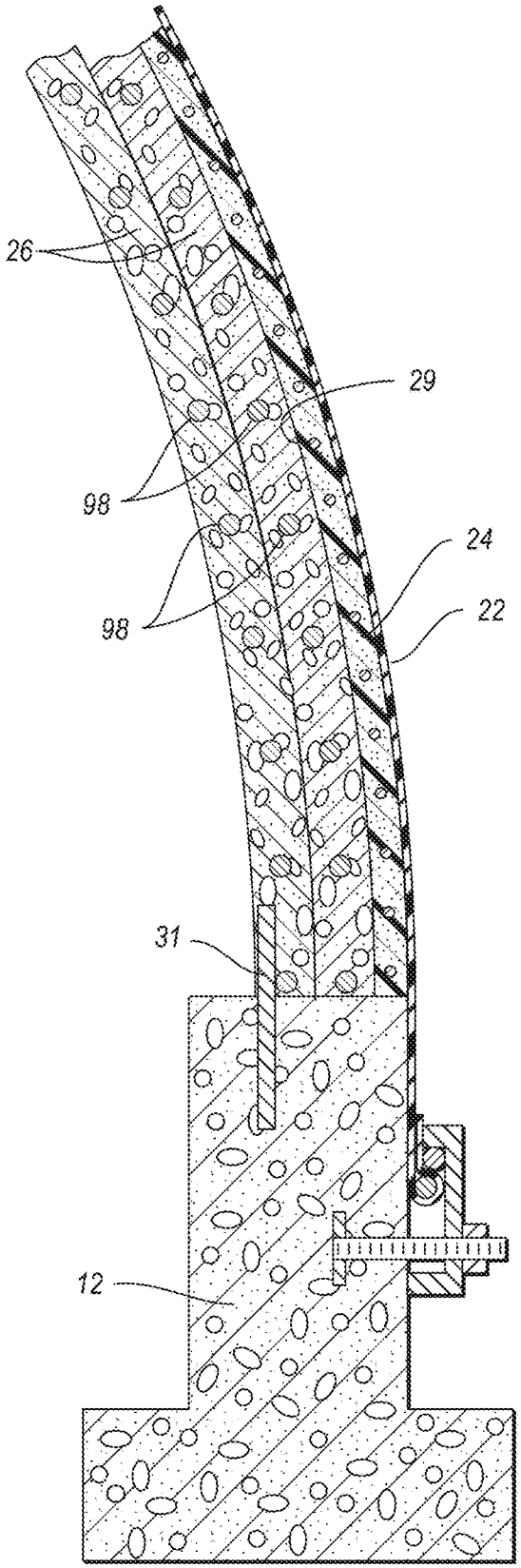
FIG. 18 is the cross sectional view shown in FIG. 17 having a second rebar mat and a second support layer disposed thereon.

It will be appreciated that two or more support layers 26 may be formed in building structure 10 so that building 10 has sufficient structural strength. As shown in FIG. 18, two support layers 26 are shown each having a separate reinforcing mat 98 embedded therein. For example, during formation or subsequent to formation of first support layer 26, hangers 58 (FIG. 2) can be secured to first support layer 26. Once first support layer 26 is finished, a separate reinforcing mat 98 can be formed adjacent to the interior surface of first support layer 26 using the same process as described above for securing reinforcing mat 98 adjacent to interior surface 29 of stabilizing layer 24. Once the second reinforcing mat 98 is formed, the second support layer 26 can formed over the second reinforcing mat 98 and against first support layer 26. It is appreciated that the type/configuration of reinforcing mat 98 may differ between different support layers 26. Furthermore, the type/configuration of reinforcing mat 98 and number of support layers 26 will vary depending on the engineering requirements of the particular building structure 10.

As previously discussed, although not required, in one embodiment as the various layers or materials are added to building 10, the air pressure within chamber 20 is periodically increased, through the use of blower 57 (FIG. 3) so as to compensate for the load produced by the added weight. This increase in pressure can be accomplished in one or more stages. Once all of the layers are applied and cured to the extent necessary to provide the independent support strength, blower 57 is turned off and disconnected from building 10.

After completing building 10 thus far described, the various doorways, windows, and other openings can be cut through boundary wall 14. Inflatable form 22 may be removed from stabilizing layer 24, if desired, and a protective coating such as asphalt and/or a suitable paint can be applied over stabilizing layer 24 to protect it from moisture and ultraviolet degradation caused by exposure to the sun. Inflatable form 22 may then be reused. Alternatively, inflatable form 22 may be retained on the completed building 10 and, if desired, coated to provide additional protection to building 10. A further alternative is to remove inflatable form 22, apply a coating of cementitious material to the lower outer exposed portion of stabilizing layer 24 followed by a moisture barrier coating of asphalt over the entire structure and a final coating of paint for obtaining the desired appearance. The combination of stabilizing layer 24 with or without inflatable form 22 and with or without various outer coating are examples of outer structures of building 10. Further methods, details, and alternatives for forming buildings incorporating the methods herein are disclosed in U.S. Pat. No. 6,840,013 which was previously incorporated herein by specific reference.

VIII. Retrofitting

In contrast to using the above process to fabricate new buildings, such as storage silos, the above process can also be used to retrofit existing buildings, such as conventional storage silos. That is, there are an extensive number of conventional storage silos and the like that have deteriorated over time and need to be retrofitted with a reinforcing structure to maintain their proper structural integrity. Retrofitting a preexisting building with a reinforcing structure using conventional techniques is expensive, time consuming, and very labor intensive. However, by using the process described herein, the needed retrofitting can be produced quicker, with less labor, and at a significant reduction in cost.

Figure 19:
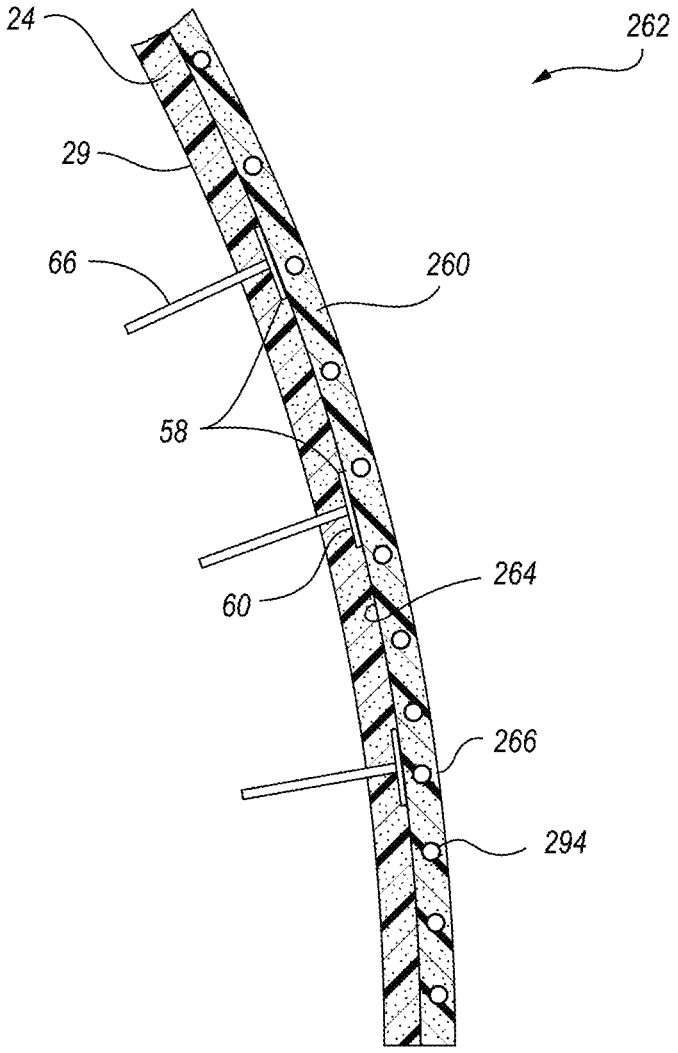
FIG. 19 is a cross sectional view of a portion of a perimeter wall of a preexisting building having hangers and a stabilizing layer disposed on an interior surface thereof.

For example, depicted in FIG. 19 is an outer perimeter wall 260 of a preexisting building 262 that needs to be retrofitted with a reinforcing structure to maintain proper structural integrity. Building 262 can be a storage silo or other type building at least a portion of which has a domed or cylindrical configuration. Perimeter wall 260 is a structure of building 262 and has an interior surface 264 and an opposing exterior surface 266. Perimeter wall 260 can be comprised of multiple layers of different materials but commonly comprises concrete having conventional pre-cut rebar sections 294 therein.

To retrofit building 262 with a reinforcing structure, hangers 58 can be mounted to interior surface 264 of perimeter wall 260 such as by use of adhesive or other attachment mechanism. The attachment can be made in the same alternative ways that hangers 58 can be attached to stabilizing layer 24 (FIG. 2) as previously discussed. Stabilizing layer 24 can then be applied over top of base plates 60 of hangers 58 and on interior surface 264 of perimeter wall 260 for further securing hangers 58 to perimeter wall 260.

In turn, in the same manner as previously discussed with regard to FIG. 5, support strands 94 can be secured to hangers 58, such as in a substantially horizontal orientation, while first reinforcing strands 95 can be secured to support strands 94, such as in a substantially vertical orientation. Second reinforcing strands 96 can then be attached to first reinforcing strands 95. Specifically, as previously discussed with regard to FIG. 6-8, mechanical lift 102 can be used to lift and move basket assembly 104 along interior surface 264 of perimeter wall 260. Concurrently, coiled rebar dispenser 120 can be used to rotate rebar coil 128 so as to progressively dispense rebar strand 190/second reinforcing strand 96 which can pass through rebar straightener 140 (FIG. 12) and subsequently be secured to strands 94 and/or 95 by operators standing on basket assembly 104. That is, rebar strand 190/second reinforcing strand 96 can be attached to strands 94 and/or 95 mounted on perimeter wall 260 using any of the methods, apparatus, and alternatives as previously discussed with the attachment of rebar strand 190/second reinforcing strand 96 to strands 94 and/or 95 disposed on stabilizing layer 24.

Finally, once reinforcing matt 98 is secured, support layer 26, such as previously discussed with regard to FIG. 17, is disposed over reinforcing matt 98 and allowed to set, thereby forming the reinforcing structure to support perimeter wall 260. As needed, as previously discussed with regard to FIG. 18, a second reinforcing matt 98 can be secured interior of support layer 26 while a second support layer 26 can be disposed over second reinforcing matt 98, thereby further supporting perimeter wall 260.

Embodiments of the present disclosure can achieve a number of unique benefits. For example, using a continuous strand of rebar uncoiled from rebar coil 128 to form second reinforcing strands 96 of reinforcing mat 98, as discussed herein, significantly reduces the expense, production time, and labor needed to produce building 10 and/or reinforce perimeter wall 260 of preexisting building 262 and, more specifically, to produce reinforcing mat 89. That is, concurrently uncoiling rebar coil 128 and mounting the uncoiled strand thereof as reinforcing is substantially faster than conventional methods of mounting short precut strands of rebar. For example, using extended lengths of uncoiled rebar as reinforcing eliminates or at least limits the need to custom cut and then store and track different lengths of rebar. Furthermore, using coiled rebar mounting assemblies disclosed herein to support, position, unwind, and mount rebar from rebar coil 128 reduces the number of labors needed and helps eliminate downtime previously encountered in having to frequently retrieve short strands of rebar for mounting. In addition, using an elongated strand of rebar as opposed to multiple short strands helps eliminate wasteful over lapping and tying of rebar. Also, by reducing unnecessary overlapping and tying of rebar, the overall strength of the rebar mat is stronger, thereby enabling the size and/or amount of rebar to be reduced. Other benefits also exist.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, processes, and/or products according to certain embodiments of the present disclosure may include, incorporate, or otherwise comprise properties features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative assemblies, processes, products, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A method for fabricating or retrofitting a building, the method comprising:

positioning a coil of rebar toward an interior surface of a structure of a building, the coil of rebar being supported by an arm of a mechanical lift, the structure of the building at least partially bounding a chamber;

uncoiling a section of rebar from the coil of rebar by rotating the coil of rebar supported by the arm of a mechanical lift; and securing the uncoiled section of rebar to the interior surface of the structure while the uncoiled section of rebar remains connected to the coil of rebar.

2. The method as recited in claim 1, wherein the structure comprises an outer perimeter wall of a preexisting building.

3. The method as recited in claim 1, wherein the structure comprises a stabilizing layer disposed on at least a portion of an interior surface of an inflated form.

4. The method as recited in claim 1, further comprising spraying a cementitious material over the uncoiled section of rebar secured to the structure.

5. The method as recited in claim 1, wherein the uncoiled section of rebar secured to the structure has a linear length of at least 50 meters and the coil of rebar comprises a coiled strand of rebar having a length of at least 50 meters.

6. The method as recited in claim 1, further comprising connecting a secondary rebar to rebar hangers extending from the structure, wherein securing the uncoiled section of rebar to the structure comprises securing the uncoiled section of rebar directly to the secondary rebar.

7. The method as recited in claim 1, further comprises:

the coil of rebar being positioned on a basket assembly that is supported by the arm of the mechanical lift, the mechanical lift being located within the chamber of the structure; and rotating the coil of rebar positioned on the basket assembly so as to uncoil the section of rebar.

8. The method as recited in claim 7, further comprising raising the basket assembly having the coil of rebar positioned thereon to an elevated position adjacent to the structure of the building before securing the uncoiled section of rebar to the interior surface of the structure.

9. The method as recited in claim 7, further comprising moving the basket assembly relative to the structure while concurrently rotating the coil of rebar positioned on the basket assembly so as to uncoil the section of rebar while the basket assembly is moving.

10. The method as recited in claim 7, wherein rotating the coil of rebar comprises:

mounting the coil of rebar on a motor driven, coiled-rebar dispenser disposed on the basket assembly; and activating the coiled-rebar dispenser so as to rotate the coil of rebar and uncoil the section of rebar.

11. The method as recited in claim 10, wherein the mechanical lift and the coiled-rebar dispenser are each electrically coupled to a controller, the controller being programmed to automatically correlate movement of the basket assembly by the mechanical lift with rotation of the coil of rebar by the coiled-rebar dispenser.

12. The method as recited in claim 10, wherein the coil of rebar has a central axis of rotation about which the coil of rebar rotates while the section of rebar is uncoiled from the coil of rebar, the coil of rebar being disposed on the coiled-rebar dispenser so that the axis of rotation is either substantially vertical or substantially horizontal as the coil of rebar is rotated.

13. The method as recited in claim 10, wherein the basket assembly comprises:

a base support secured to the arm of the mechanical lift; and a platform pivotably mounted to the base support, the coiled-rebar dispenser and coil of rebar being disposed on the platform.

14. The method as recited in claim 1, further comprising passing the uncoiled section of rebar through a rebar straightener before securing the uncoiled section of rebar to the structure.

15. The method as recited in claim 1, further comprising:

rotating the coil of rebar to uncoil further sections of rebar from the coil of rebar; and securing the further sections of rebar to the structure of the building while the further sections of rebar remain secured to the coil of rebar.

16. The method as recited in claim 1, wherein the mechanical lift is configured to raise, lower, and laterally move the arm.

17. The method as recited in claim 1, further comprising moving the coil of rebar relative to the structure while concurrently rotating the coil of rebar supported by the mechanical lift so as to uncoil the section of rebar while the arm of a mechanical lift is moving.

18. A method for fabricating or retrofitting a building, the method comprising:

securing a secondary rebar to rebar hangers extending from an interior surface of a structure of a building, the structure of the building at least partially bounding a chamber;

positioning a coil of primary rebar toward the interior surface of the structure of the building;

uncoiling a section of primary rebar from the coil of primary rebar; and securing the uncoiled section of primary rebar to the secondary rebar while the uncoiled section of primary rebar remains connected to the coil of primary rebar.

19. The method as recited in claim 18, wherein securing the secondary rebar to the rebar hangers comprises:

securing supporting strands of rebar to the rebar hangers so that the supporting strands of rebar are substantially horizontally disposed; and securing reinforcing strands of rebar to the supporting strands of rebar so that the reinforcing strands of rebar are substantially vertically disposed and cross over the supporting strands of rebar, wherein the uncoiled section of primary rebar is secured directly to the reinforcing strands of rebar so that the uncoiled section of primary rebar is substantially horizontally disposed.

20. The method as recited in claim 18, wherein the uncoiled section of primary rebar secured to the secondary rebar has a linear length of at least 50 meters and the coil of primary rebar comprises a coiled strand of primary rebar having a length of at least 50 meters.

21. A method for fabricating or retrofitting a building, the method comprising:

positioning a coil of rebar toward an interior surface of a structure of a building, the structure of the building at least partially bounding a chamber;

uncoiling a section of rebar from the coil of rebar;

securing the uncoiled section of rebar to the interior surface of the structure while the uncoiled section of rebar remains connected to the coil of rebar; and spraying a cementitious material over the uncoiled section of rebar secured to the structure.

22. The method as recited in claim 21, wherein the cementitious material is sprayed over the uncoiled section of rebar after the coil of rebar has been completely uncoiled and secured to the interior surface of the structure.

23. The method as recited in claim 21, wherein the uncoiled section of rebar secured to the structure has a linear length of at least 50 meters and the coil of rebar comprises a coiled strand of rebar having a length of at least 50 meters.

24. A method for fabricating or retrofitting a building, the method comprising:

positioning a coil of rebar toward an interior surface of a structure of a building, the structure of the building at least partially bounding a chamber;

uncoiling a first section of rebar from the coil of rebar;

securing the uncoiled first section of rebar to the interior surface of the structure while the uncoiled first section of rebar remains connected to the coil of rebar;

uncoiling a second section of rebar from the coil of rebar after securing the uncoiled first section of rebar to the interior surface of the structure; and securing the uncoiled second section of rebar to the interior surface of the structure while the uncoiled second section of rebar remains connected to first section of rebar and the coil of rebar.

* * * * *